US008338066B2

(12) United States Patent
Nozaki et al.

(10) Patent No.: US 8,338,066 B2
(45) Date of Patent: Dec. 25, 2012

(54) TONER, PROCESS CARTRIDGE AND METHOD OF FORMING IMAGE

(75) Inventors: Tsuyoshi Nozaki, Ikeda (JP); Chiyoshi Nozaki, Otsu (JP); Atsushi Yamamoto, Kawanishi (JP); Minoru Nakamura, Mishima (JP); Akira Izutani, Takatsuki (JP)

(73) Assignee: Ricoh Company, Ltd., Tokyo (JP)

( * ) Notice: Subject to any disclaimer, the term of this patent is extended or adjusted under 35 U.S.C. 154(b) by 634 days.

(21) Appl. No.: 12/552,658

(22) Filed: Sep. 2, 2009

(65) Prior Publication Data

US 2010/0055603 A1 Mar. 4, 2010

(30) Foreign Application Priority Data

Sep. 3, 2008 (JP) ..... 2008-225546
Jun. 15, 2009 (JP) ..... 2009-142185

(51) Int. Cl.
*G03G 9/087* (2006.01)

(52) U.S. Cl. ..... 430/109.1; 430/109.3; 430/109.4

(58) Field of Classification Search ..... 430/109.1, 430/109.3, 109.4
See application file for complete search history.

(56) References Cited

U.S. PATENT DOCUMENTS

| | | | | |
|---|---|---|---|---|
| 7,550,242 | B2 | 6/2009 | Nozaki et al. | |
| 7,556,904 | B2 | 7/2009 | Kadota et al. | |
| 2006/0160011 | A1* | 7/2006 | Inoue et al. | 430/109.4 |
| 2006/0210902 | A1 | 9/2006 | Nakamura et al. | |
| 2006/0240349 | A1* | 10/2006 | Watanabe et al. | 430/108.4 |
| 2007/0026335 | A1 | 2/2007 | Yamamoto et al. | |
| 2007/0059625 | A1 | 3/2007 | Yamamoto et al. | |
| 2007/0166635 | A1 | 7/2007 | Yamamoto et al. | |
| 2007/0190442 | A1 | 8/2007 | Nakamura et al. | |
| 2007/0207399 | A1 | 9/2007 | Kadota et al. | |
| 2007/0218384 | A1 | 9/2007 | Matsumoto et al. | |
| 2007/0218388 | A1 | 9/2007 | Kurose et al. | |
| 2007/0218393 | A1 | 9/2007 | Nozaki et al. | |
| 2008/0038656 | A1 | 2/2008 | Yasunaga et al. | |
| 2008/0069617 | A1 | 3/2008 | Matsumoto et al. | |
| 2008/0131797 | A1 | 6/2008 | Ishikawa et al. | |
| 2008/0232857 | A1 | 9/2008 | Matsumoto et al. | |
| 2009/0186289 | A1 | 7/2009 | Nakamura et al. | |

FOREIGN PATENT DOCUMENTS

| | | |
|---|---|---|
| JP | 11-7156 | 1/1999 |
| JP | 3577390 | 7/2004 |
| JP | 2004-271686 | 9/2004 |
| JP | 2004-295105 | 10/2004 |
| JP | 2005-84183 | 3/2005 |
| JP | 2007-146120 | 6/2007 |
| JP | 2008-70829 | 3/2008 |

OTHER PUBLICATIONS

U.S. Appl. No. 12/017,853 of Mitsuyo Matsumoto et al., filed Jan. 22, 2008 (Claims, Abstract, Drawings).
U.S. Appl. No. 12/389,823 (Claims, Abstract, Drawings).

* cited by examiner

*Primary Examiner* — Hoa V Le
(74) *Attorney, Agent, or Firm* — Cooper & Dunham LLP

(57) ABSTRACT

A toner including a resin having a polyester skeleton, a coloring agent, a vinyl based copolymer resin, and a releasing agent, wherein the toner is manufactured by dissolving or dispersing a resin including the resin having a polyester skeleton and a mixture of the vinyl based copolymer resin and the releasing agent in an organic solvent to obtain a lysate and/or a dispersion material, dispersing the lysate and/or the dispersion material in an aqueous medium to obtain a liquid dispersion and removing the organic solvent from the liquid dispersion.

19 Claims, 4 Drawing Sheets

• COLORING AGENT

VINYL BASED POLYMER RESIN CONTAINING RELEASING AGENT

TONER, PROCESS CARTRIDGE AND METHOD OF FORMING IMAGE

BACKGROUND OF THE INVENTION

1. Field of the Invention

The present invention relates to a toner, a process cartridge, and method of forming an image.

2. Discussion of the Background

Original and innovative researches and development have been made for electrophotography with various kinds of technical approaches. In the electrophotography, an image is formed by developing a latent electrostatic image formed by charging and irradiating the surface of an image bearing member with a colored toner to obtain a toner image, transferring the toner image to a transfer medium such as transfer paper, and fixing the toner image thereon with a heating roller, etc. A contact heating fixing system such as a heating roller fixing system is widely employed as the fixing system for toner.

The fixing device for use in the heating roller fixing system includes a heating roller and a pressure roller. In this fixing system, the toner image is fixed on the recording sheet by melting when a recording sheet bearing the toner image passes through a contact pressure (nip) portion of the heating roller and the pressure roller.

The viscosity of the melted toner drastically lowers, which easily causes an offset phenomenon in which toner is attached to the heating roller, or a winding phenomenon in which the recording sheet winds around and thus is unseparated from the heating roller.

A lubricant such as silicon oil is applied to the roller to prevent these phenomena. However, an oil application device is required, which leads to problems such as a cost increase and a size increase of the fixing portion.

In addition, the obtained image may shine due to the oil attached thereto or the oil attached to the image prevents writing on the image with a pen.

Another prevention method is provided in which a toner containing a releasing agent in its inside is used.

In this method, attachment of the toner to the heating roller is prevented by melted releasing agent oozed from the inside of the toner when the toner is melted. The releasing agent ideally has the following characteristics: (1) melting at a temperature as low as possible; (2) less amount of heat required for melting; (3) low melt viscosity; and (4) swift and steady move from the inside of the toner to the uppermost surface thereof. The required amount of the releasing agent is reduced and the fixing temperature is lowered when the releasing agent has these characteristics. In addition, the electricity consumed by the heating roller, etc. is saved and a large margin is obtained for improving the system speed (printing speed).

However, when a releasing agent having an extremely low melting point is used to satisfy (1), the releasing agent in the toner is possibly melted at a temperature rise in an image forming apparatus, for example, a development device, caused by the environmental change and/or driving of the devices, which causes a problem.

Therefore, the method of simply lowering the melting point of a releasing agent is limiting.

In addition, satisfying (2) greatly depends on the amount of the releasing agent contained in a toner. Excessive reduction of the amount of the releasing agent has an adverse impact on the releasing effect. To the contrary, an excessive amount of the releasing agent tends to require a large amount of heat and cause the releasing agent to be present exposed to the surface of the toner.

In addition, (3) significantly depends on the kind of the releasing agent, and a mutual function between the molecules of the releasing agent is preferably small. Thus, a releasing agent having a low polar structure is preferable.

However, a change in the polarity of the releasing agent has an impact on the compatibility and the mutual function between the releasing agent and the binder resin in the toner. Therefore, that the present status and the existing position of the releasing agent inside the toner greatly vary should be considered.

(4) is greatly dependent on the position and the existing status of the releasing agent inside the toner.

When the releasing agent is present close to the center of the inside of the toner, the releasing agent does not easily move to the surface of the toner when the toner is heated and fixed. Thus, preferably the releasing agent is evenly dispersed inside the toner or present close to the surface of the toner to a degree not to cause a problem to the development device, etc.

In addition, when the existing status (hereinafter referred to as domain) of the releasing agent is small (fine dispersion), the releasing agent is difficult to move inside the toner when melted or the extrusion effect by distortion due to the pressure is hardly obtained.

This is a disadvantage particularly when the domain is spherical. Thus, the form of the domain is preferably a stick or disc form.

A vinyl based polymeric resin and a resin having a polyester skeleton are typical examples of the resin for use in the toner.

These resins have advantages and disadvantages respectively with regard to the toner functions and characteristics such as fluidity, mobility, chargeability, fixability and image characteristics. Therefore, a mixture of both resins and/or a hybrid resin having both skeletons have been widely used in recent years.

In addition to the typical mixing, kneading and pulverization method as the toner manufacturing method, there are wet granulation methods also referred to as chemical toner methods such as a suspension method or emulsification method in which an organic solvent and an aqueous medium are used, a suspension polymerization method in which toner particles are directly obtained by controlling and polymerizing polymerizable monomer droplets, and an agglomeration method in which toner particles are agglomerated by preparing emulsified particulates.

For example, unexamined published Japanese patent application No. (hereinafter referred to as JOP) 2005-064183 describes a toner having a polyester based resin as a core and a vinyl based resin as a covering layer. The cover layer having resin particulates prepared by an emulsification polymerization method using a surface active agent or an emulsification dispersion method using a surface active agent is formed on the surface of a colored resin particle manufactured by an emulsification dispersion method.

JOP 2004-295105 describes a toner prepared by a process in which resin particles are agglomerated in an aqueous medium. To be specific, a liquid dispersion is prepared by dispersing a resin solution formed by dissolving a polyester resin and a styrene acryl based resin in an organic solvent in an organic solvent. Thereafter, the organic solvent is removed from the liquid dispersion followed by agglomeration of resin particles in an aqueous medium.

In addition, JOP 2004-271686 describes a toner prepared by obtaining resin particulates having a particle size of 1 μm from a polyester based resin and carnauba wax in polyaddition reaction or polycondensation reaction, dispersing the resin particulates in an aqueous medium to prepare a liquid dispersion, and salt-outing/adhering the resin particulates in the liquid dispersion in the aqueous medium.

Japanese patent No. 3577390 describes a toner obtained by preparing resin particulates having a particle size of 0.9 μm from a polyester based resin and an oxidized polypropylene followed by agglomeration.

In addition, JOP H11-007156 describes a toner prepared by forming and agglomerating resin particulates having a size of from 0.4 to 0.7 μm from a polyester based resin and paraffin wax by using suspension granulation performed by introducing into an aqueous medium a liquid mixture prepared by dissolving or dispersing toner material containing a binder resin formed of multiple polyester resins having different acid values or glass transition temperatures and a coloring agent in an organic solvent.

These chemical toner methods have various kinds of advantages over the mixing, kneading and pulverization method and are suitable to control the resin structure and the existing position of a releasing agent.

However, when a releasing agent is dispersed in a vinyl based polymerizable resin, the vinyl based polymerizable resin and the releasing agent are easily compatibilized in each other, resulting in fine dispersion.

In addition, large particulates are not granulated by emulsification polymerization, resulting in a small domain.

Furthermore, a releasing agent is dissolved in a monomer in suspension polymerization, resulting in formation of a spherical domain with the toner located in the center.

Also, the releasing agent directly contained in toner particles by a polyester dissolution suspension method is known to be exposed to the surface of the toner.

The toner prepared by the chemical toner has not fully satisfied the function and characteristics suitable as the toner nor obtained excellent fixing characteristics suitable for a full color toner dealing with a high speed printing.

SUMMARY OF THE INVENTION

Because of these reasons, the present inventors recognize that a need exists for a toner that has a sufficient chargeability and an excellent durability with a good combination of the low temperature fixability and a high temperature preservability, a method of manufacturing the toner and a process cartridge using the toner.

Accordingly, an object of the present invention is to provide a toner that has a sufficient chargeability and an excellent durability with a good combination of the low temperature fixability and a high temperature preservability, a method of manufacturing the toner and a process cartridge using the toner.

Briefly this object and other objects of the present invention as hereinafter described will become more readily apparent and can be attained, either individually or in combination thereof, by a toner including a resin having a polyester skeleton; a coloring agent; a vinyl based copolymer resin; and a releasing agent, wherein the toner is manufactured by dissolving or dispersing a resin including the resin having a polyester skeleton and a mixture of the vinyl based copolymer resin and the releasing agent in an organic solvent to obtain a lysate (liquid mixture) and/or a dispersion material of toner constituent, dispersing the lysate and/or the dispersion material in an aqueous medium to obtain a liquid dispersion and removing the organic solvent from the liquid dispersion.

Another aspect of the present invention, another toner is provided which includes a resin having a polyester skeleton; a coloring agent, a vinyl based copolymer resin; and a releasing agent, wherein the toner is manufactured by dissolving or dispersing a resin including the resin having a polyester skeleton in an organic solvent to obtain a lysate (liquid mixture) and/or a dispersion material of toner constituent, dispersing the lysate and/or the dispersion material in an aqueous medium in which a mixture of the vinyl based copolymer resin and the releasing agent is dispersed to obtain a liquid dispersion and removing the organic solvent from the liquid dispersion.

It is preferred that, in the toner described above, a vinyl based copolymer resin particulate including no releasing agent is preliminarily dispersed in the aqueous medium.

It is still further preferred that, in the toner described above, the releasing agent is paraffin wax, Fischer-Tropsch wax, or a polyethylene wax.

It is still further preferred that, in the toner described above, the mixture of the vinyl based copolymer resin and the releasing agent has a volume average particle diameter of 0.2 μm or less.

It is still further preferred that, in the toner described above, the mixture of the vinyl based copolymer resin and the releasing agent is prepared by emulsification polymerization in an aqueous medium in which the releasing agent is dispersed.

It is still further preferred that, in the toner described above, the releasing agent has an endothermic amount of 10 mJ/mg or less based on melting heat of the releasing agent in the toner according to measurement by a differential scanning calorimeter (DSC).

It is still further preferred that, in the toner described above, the resin including the resin having a polyester skeleton includes a modified polyester resin having at least one of a urethane group and a urea group.

It is still further preferred that, in the toner described above, the polyester resin includes a modified polyester component prepared by reaction between a modified polyester having an isocyanate group at an end thereof and an amine.

As another aspect of the present invention, a process cartridge is provided which includes an image bearing member that bears a latent electrostatic image thereon; and a development device that develops the latent electrostatic image on the image bearing member, the development device including a development agent bearing member that bears a development agent including the toner described above on the surface thereof, a development device supplying member that supplies the development agent to the surface of the development agent bearing device, and a development agent container that contains the development agent, wherein the process cartridge is detachably attachable to an image forming apparatus.

As another aspect of the present invention, a method of forming an image is provided which includes uniformly charging the surface of an image bearing member,irradiating the surface of the image bearing member with light according to image data to write a latent electrostatic image on the surface, developing the latent electrostatic image formed on the surface of the image bearing member via a layer of a development agent including the toner described above which is formed on a development agent bearing member with a predetermined thickness regulated by a development agent layer regulation member to obtain a visualized image, transferring the visualized image to a transfer medium; and fixing the visualized image on the transfer medium.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
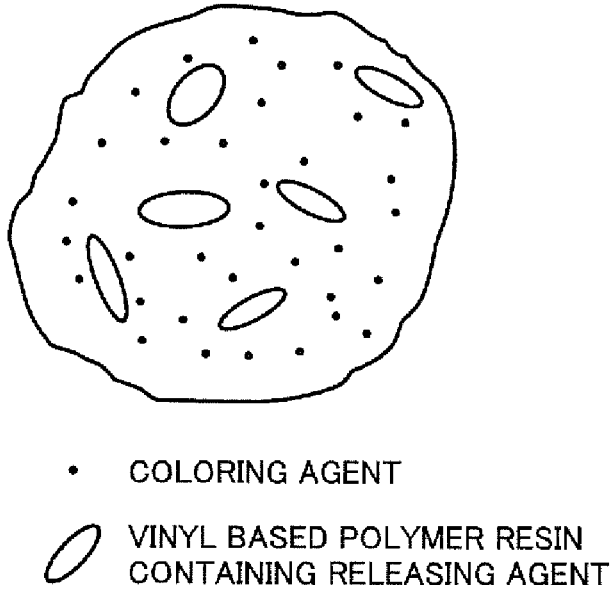
FIG. 1 is a schematic diagram illustrating the cross section of particles of the toner of the present invention.

The present invention will be described below in detail with reference to several embodiments and accompanying drawings.

Polyester Resin

Polycondensation products of the following polyols (1) and polycarboxylic acids (2) can be used as the polyester resin for use in the present invention and any combinations can be used. Also, a mixture of several kinds of polyester resins can be used.

Polyol

Specific examples of the polyols (1) include, but are not limited to, alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F, and bisphenol S), 4,4'-dihydroxybiphenyls such as 3,3-difluoro-4,4'-dihydroxybiphenyl; bis(hydroxyphenyl)alkanes such as bis(3-fluoro-4-hydroxyphenyl)methane, 1-phenyl-1,1'-bis(3-fluoro-4-hydroxyphenyl)ethane, 2,2-bis(3-fluoro-4-hydroxyphenyl)propane, 2,2-bis(3,5-difluoro-4-hydroxyphenyl)propane (also referred to as tetrafluorobisphenol A), and 2,2-bis(3-hydroxyphnyl)-1,1,1,3,3,3-hexafluoropropane; bis(4-hydorxyphenyl)ethers such as bis(3-fluoro-4-hydroxyphenyl)ether; adducts of the alicyclic diols mentioned above with an alkylene oxide (e.g., ethylene oxide, propylene oxide and butylene oxide); and adducts of the bisphenols mentioned above with an alkylene oxide (e.g., ethylene oxide, propylene oxide and butylene oxide); etc. Among these compounds, alkylene glycols having 2 to 12 carbon atoms and adducts of a bisphenol with an alkylene oxide are preferable. Adducts of bisphenol with an alkylene oxide and mixtures of an adduct of a bisphenol with an alkylene oxide and an alkylene glycol having 2 to 12 carbon atoms are particularly preferable. Specific examples of the aliphatic polyols having three or more hydroxyl groups include, but are not limited to, glycerin, trimethylol ethane, trimethylol propane, pentaerythritol and sorbitol); polyphenols having three or more hydroxyl groups (trisphenol PA, phenol novolak and cresol novolak); and adducts of the polyphenols having three or more hydroxyl groups mentioned above with an alkylene oxide. The polyols specified above can be used alone or in combination.

Polycarboxylic Acid

Specific examples of the polycarboxylic acids (2) include, but are not limited to, alkylene dicarboxylic acids (e.g., succinic acid, adipic acid and sebacic acid); alkenylene dicarboxylic acids (e.g., maleic acid and fumaric acid); and aromatic dicarboxylic acids (e.g., phthalic acid, isophthalic acid, terephthalic acid, naphthalene dicarboxylic acids, 3-fluoroisophtahlic acid, 2-fluoroisophthalic acid, 2-fluoroterephtahlic acid, 2,4,5,6-tetrafluoroisophtahlic acid, 2,3,5,6-tetrafluoro terephthalic acid, 5-trifluoromthyl isophthalic acid, 2,2-bis(4-carboxyphenyl)hexafluoropropane, 2,2-bis(4-carboxyphenyl)hexafluoro propane, 2,2-bis(3-carboxyphenyl) hexafluoropropane, 2,2'-bis(trifluoromethyl)-4,4'-biphenyl dicarboxylic acid, 3,3'-bis(trifluoromethyl)4,4'-biphenyl dicarboxylic acid, 2,2'-bis(trifluoromethyl)-3,3'-biphenyl dicarboxylic acid, and hexafluoro isopropylidene diphthalic anhydride). Among these compounds, alkenylene dicarboxylic acids having 4 to 20 carbon atoms and aromatic dicarboxylic acids having 8 to 20 carbon atoms are preferably used. Specific examples of the polycarboxylic acids having three or more hydroxyl groups include, but are not limited to, aromatic polycarboxylic acids having 9 to 20 carbon atoms (e.g., trimellitic acid and pyromellitic acid). Anhydrides or lower alkyl esters (e.g., methyl esters, ethyl esters or isopropyl esters) of the polycarboxylic acids specified above reacted with a polyol (1) can be used. The polycarboxylic acids specified above can be used alone or in combination and are not limited to the specified above.

Ratio of Polyol to Polycarboxylic Acid

The suitable mixing ratio (i.e., an equivalence ratio [OH]/[COOH]) of a polyol (PO) to a polycarboxylic acid (PC) is from 2/1 to 1/1, preferably from 1.5/1 to 1/1 and more preferably from 1.3/1 to 1.02/1.

Molecular Weight of Polyester Resin

The peak molecular weight is from 1,000 to 30,000, preferably from 1,500 to 10,000 and more preferably from 2,000 to 8,000. When the peak molecular weight is too small, the high temperature preservability of the toner tends to deteriorate. When the peak molecular weight is too large, the low temperature fixing property easily deteriorates.

Modified Polyester Resin

The binder resin for use in the present invention optionally includes an unmodified polyester resin having a urethane and/or urea group to adjust the viscosity and elasticity. The content ratio of the modified polyester resin having a urethane and/or urea group in the binder resin is preferably not greater than 20% by weight, more preferably not greater than 15% by weight, and furthermore preferably not greater than 10% by weight. A content ratio that is too high tends to degrade the low temperature fixing property. The modified polyester resin having an urethane and/or urea group can be directly mixed with the binder resin (A) but is preferably manufactured by mixing a modified polyester having an isocyanate group at its end and a relatively low molecular weight (hereafter referred to as prepolymer), an amine reactive therewith and the binder resin followed by elongation reaction and/or cross-linking reaction during or after granulation to obtain a modified polyester resin having an urethane and/or urea group. Thereby, the binder resin can easily contain a modified polyester resin having a relatively large molecular weight for adjustment of viscosity and elasticity.

Prepolymer

The polyester prepolymer mentioned above can be prepared by, for example, reacting a polyester having an active hydrogen group, which is a polycondensation product of a polyol (1) and a polycarboxylic acid (2), and a polyisocyanate (3). Specific examples of the active hydrogen group contained in the polyester mentioned above including the mentioned above include, but are not limited to, hydroxyl groups (alcohol hydroxyl groups and phenol hydroxyl groups), amino groups, carboxylic groups, and mercarpto groups. Among these, alcohol hydroxyl groups are particularly preferred.

Polyisocyanate

Specific examples of the polyisocyanates (3) include, but are not limited to, aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisosycantes (e.g., tolylene diisocyanate and diphenylmethane diisocyanate); aromatic aliphatic diisocyanates (e.g., α,α,α',α'-tetramethyl xylylene diisocyanate); isocyanurates; blocked polyisocyanates in which the polyisocyanates mentioned above are blocked with phenol derivatives thereof, oximes or caprolactams; etc. These compounds can be used alone or in combination.

Ratio of Isocyanate Group to Hydroxyl Group

Suitable mixing ratio (i.e., [NCO]/[OH]) of a polyisocyanate (PIC) to a polyester having a hydroxyl group is from 5/1 to 1/1, preferably from 4/1 to 1.2/1 and more preferably from 2.5/1 to 1.5/1. When the [NCO]/[OH] ratio is too large, the low temperature fixability of the toner tends to deteriorate. When the molar ratio of [NCO] is too small, the urea content of a modified polyester tends to be small and the hot offset resistance easily deteriorates. The content ratio of the constitutional component of a polyisocyanate (PIC) (3) in the polyester prepolymer (A) having a polyisocyanate group at its end portion is from 0.5 to 40% by weight, preferably from 1 to 30% by weight and more preferably from 2 to 20% by weight. When the content ratio is too low, the hot offset resistance of the toner easily deteriorates. In contrast, when the content ratio is too high, the low temperature fixability of the toner tends to deteriorate.

Number of Isocyanate Groups in Prepolymer

The number of isocyanate groups included in the prepolymer (A) per molecule is normally not less than 1, preferably from 1.5 to 3, and more preferably from 1.8 to 2.5. When the number of isocyanate groups is too small, the molecular weight of urea-modified polyester tends to be small and the hot offset resistance easily deteriorates.

Elongation Agent and/or Cross Linking Agent

In the present invention, amines can be used as an elongation agent and/or a cross linking agent.

Specific examples of the amines (B) include, but are not limited to, diamines (B1), polyamines (B2) having three or more amino groups, amino alcohols (B3), amino mercaptans (B4), amino acids (B5), and blocked amines (B6) in which the amines (B1-B5) mentioned above are blocked. The following can be used as the diamine (B1). Aromatic diamines (e.g., phenylene diamine, diethyltoluene diamine, 4,4-diamino-diphenyl methane, tetrafluoro-p-xylylene diamine, and tetrafluoro-p-phenylene diamine); alicyclic diamines (e.g., 4,4-diamino-3,3-dimethyldicyclohexyl methane, diaminocyclohexane and isophoron diamine); aliphatic diamines (e.g., ethylene diamine, tetramethylene diamine, hexamethylene diamine, dodecafluorohexylene diamine, and tetracosafluorododecylene diamine).

Specific examples of the polyamines (B2) having three or more amino groups include, but are not limited to, diethylene triamine, and triethylene tetramine. Specific examples of the amino alcohols (B3) include, but are not limited to, ethanol amine and hydroxyethyl aniline.

Specific examples of the amino mercaptan (B4) include, but are not limited to, aminoethyl mercaptan and aminopropyl mercaptan.

Specific examples of the amino acids (B5) include, but are not limited to, amino propionic acid and amino caproic acid.

Specific examples of the blocked amines (B6) include, but are not limited to, ketimine compounds which are prepared by reacting one of the amines B1-B5 mentioned above with a ketone such as acetone, methyl ethyl ketone and methyl isobutyl ketone; oxazoline compounds, etc.

Molecular Weight Control Agent

Furthermore, the molecular weight of the modified polyesters after the cross linking reaction and/or the elongation reaction can be controlled by using a molecular-weight control agent, if desired.

Specific examples of the molecular-weight control agent include, but are not limited to, monoamines (e.g., diethyl amine, dibutyl amine, butyl amine and lauryl amine), and blocked amines (i.e., ketimine compounds) prepared by blocking the monoamines mentioned above.

Ratio of Amino Group to Isocyanate Group The mixing ratio of the isocyanate group to the amines (B), i.e., the equivalent ratio ([NCO]/[NHx]) of the isocyanate group ENCO) contained in the prepolymer (A) to the amino group [NHx] contained in the amines (B), is normally from 1/2 to 2/1, preferably from 1.5/1 to 1/1.5 and more preferably from 1.2/1 to 1/1.2. When the mixing ratio is too large or too small, the molecular weight of the resultant urea-modified polyester (i) decreases, resulting in deterioration of the hot offset resistance of the resultant toner.

Vinyl Based Copolymer Resin

There is no specific limit to the selection of the vinyl based copolymer resins for use in the present invention and any can be used. Also, a mixture of several kinds of vinyl based copolymer resins can be used.

The weight average molecular weight is preferably from 3,000 to 5,000, more preferably from 5,000 to 30,000 and furthermore preferably from 7,000 to 20,000. A weight average molecular weight that is excessively small tends to cause fixation in the development device, etc. and a weight average molecular weight that is excessively large tends to degrade the low temperature fixing property.

The glass transition temperature is preferably from 40 to 80° C. and more preferably from 50 to 70° C. When the glass transition temperature is too high, the low temperature fixing property tends to deteriorate and when the glass transition temperature is too low, the high temperature preservability tends to deteriorate.

The vinyl based copolymer resins are copolymerized polymers of vinyl based monomers. Specific examples of the vinyl based monomers include, but are not limited to, the following (1) to (10)

(1) Vinyl Based Hydrocarbon

Aliphatic vinyl based hydrocarbons: alkenes such as ethylene, propylene, butane, isobutylene, pentene, heptene, diisobutylene, octane, dodecene, octadecene, α-olefins other than the above mentioned; alkadiens such as butadiene, isoplene, 1,4-pentadiene, 1,6-hexadiene, and 1,7-octadiene.

Alicyclic vinyl based hydrocarbons: mono- or di-cycloalkenes and alkadiens such as cyclohexene, (di)cyclopentadiene, vinylcyclohexene, and ethylidene bicycloheptene; and terpenes such as pinene, limonene and indene.

Aromatic vinyl-based hydrocarbons: styrene and its hydrocarbyl (alkyl, cycloalkyl, aralkyl and/or alkenyl) substitutes, such as α-methylstyrene, vinyl toluene, 2,4-dimethylstyrene, ethylstyrene, isopropyl styrene, butyl styrene, phenyl styrene, cyclohexyl styrene, benzyl styrene, crotyl benzene, divinyl benzene, divinyl toluene, divinyl xylene, and trivinyl benzene; and vinyl naphthalene.

(2) Vinyl Based Monomer Containing Carboxyl Group and its Salts

Unsaturated mono carboxylic acid and unsaturated dicarboxylic acid having 3 to 30 carbon atoms, and their anhydrides and their monoalkyl (having 1 to 24 carbon atoms) esters, such as vinyl based monomers having carboxylic group such as (meth)acrylic acid, (anhydride of) maleic acid, mono alkyl esters of maleic acid, fumaric acid, mono alkyl esters of fumaric acid, crotonic acid, itoconic acid, mono alkyl esters of itaconic acid, glycol monoether of itaconic acid, citraconic acid, mono alkyl esters of citraconic acid and cinnamic acid.

(3) Vinyl Based Monomer Having Sulfonic Group, Monoesterified Vinyl Based Sulfuric Acid and their Salts Alkene sulfuric acid having 2 to 14 carbon atoms such as vinyl sulfuric acid, (meth)aryl sulfuric acid, methylvinylsufuric acid and styrene sulfuric acid; their alkyl delivatives having 2 to 24 carbon atoms such as α-methylstyrene sulfuric acid; sulfo(hydroxyl)alkyl-(meth)acrylate or (meth)acryl amide such as sulfopropyl(meth)acrylate, 2-hydroxy-3-(meth)acryloxy propylsulfuric acid, 2-(meth)acryloylamino-2,2-dimethylethane sulfuric acid, 2-(meth)acryloyloxyethane sulfuric acid, 3-(meth)acryloyloxy-2-hydroxypropane sulfuric acid, 2-(meth)acrylamide-2-methylpropane sulfuric acid, 3-(meth)avrylamide-2-hydroxy propane sulfuric acid, alkyl (having 3 to 18 carbon atoms) aryl sulfosuccinic acid, sulfuric esters of poly (n=2 to 30) oxyalkylene (ethylene, propylene, butylenes: (mono, random, block) mono(meth)acrylate such as sulfuric acid ester of poly (n=5 to 15) oxypropylene monomethacrylate, and sulfuric acid ester of polyoxyethylene polycyclic phenyl ether.

(4) Vinyl Based Monomer Having Phosphoric Group and its Salts

Phosphoric acid monoester of (meth)acryloyl oxyalkyl such as 2-hydroxyethyl(meth)acryloyl phosphate, phenyl-2-acyloyloxyethylphosphate, (meth)acryloyloxyalkyl (having 1 to 24 carbon atoms) phosphonic acids such as 2-acryloyloxy ethylphosphonic acid and their salts, etc.

Specific examples of the salts of the compounds of (2) to (4) include, but are not limited to, alkali metal salts (sodium salts, potassium salts, etc.), alkali earth metal salts (calcium salts, magnesium salts, etc.), ammonium salts, amine salts, quaternary ammonium salts, etc.

(5) Vinyl Based Monomer Having Hydroxyl Group

Hydroxystyrene, N-methylol(meth)acryl amide, hydroxyethyl(meth)acrylate, (meth)arylalcohol, crotyl alcohol, isocrotyl alcohol, 1-butene-3-ol, 2-butene-1-ol, 2-butene-1,4-diol, propargyl alcohol, 2-hydroxyethylpropenyl ether, simple sugar aryl ether, etc.

(6) Vinyl Based Monomer Having Nitrogen

Vinyl based monomer having an amino group: aminoethyl (meth)acrylate, dimethylaminoethyl(meth)acrylate, diethylaminoethyl(meth)acrylate, t-butylaminoethyl(meth)acrylate, N-aminoethyl(meth)acrylamide, (metha)arylamine, morpholino ethyl(meth)acrylate, 4-vinylpyridine, 2-vinylpyridine, crotyl amine, N,N-dimethylaminostyrene, methyl-α-acetoaminoacrylate, vinylimidazole, N-vinylpyrrole, N-vinylthiopyrolidone, N-arylphenylene diamine, aminocarbozole, aminothiazole, aminoindole, aminopyrrole, aminoimidazole, and aminomercaptothiazole and their salts.

Vinyl Based Monomer Having Amide Group: (meth)acrylamide, N-methyl(meth)acrylamide, N-butylacrylamide, diacetone acrylamide, N-methylol(meth)acrylamide, N,N-methylene-bis(meth)acrylamide, cinnamic amide, N,N-dimethylacrylamide, N,N-dibenzylacrylamide, methacrylformamide, N-methyl-N-vinylacetoamide, and N-vinylpyrolidone.

Vinyl Based Monomer Having Nitrile Group: (meth)acrylonitrile, cyanostyrene and cyanoacrylate.

Vinyl Based Monomer Having Quaternary Ammonium Group: quaternarized vinyl based monomer having tertiary amine group such as dimethylaminoethyl(meth)acrylate, diethylaminoethyl(meth)acrylate, dimethylaminoethyl (meth)acrylamide, diethylaminoethyl(meth)acrylamide, diarylamine, etc. (quaternaized by using a quaternarizing agent such as methylchloride, dimethyl sulfuric acid, benzyl chloride, dimethylcarbonate).

Vinyl Based Monomer Having Nitro Group: nitrostyrene, etc.

(7) Vinyl Based Monomer Having Epoxy Group

Glycidyl(meth)acrylate, tetrahydrofurfuryl(meth)acrylate, and p-vinylphenyl phenyloxide.

(8) Vinyl Esters, Vinyl(thio)ether, Vinylketone, Vinyl Sulfonic Acid

Vinyl esters: Vinyl acetate, vinyl butylate, vinyl propionate, vinyl butyrate, diarylphthalate, diaryladipate, isopropenyl acetate, vinylmethacrylate, methyl-4-vinylbenzoate, cyclohexylmethacrylate, benzylmethacrylate, phenyl(meth) acrylate, vinylmethoxyacetate, vinylbenzoate, ethyl-α-ethoxyacrylate, alkyl (having 1 to 50 carbon atoms) (meth) acrylate such as methyl(meth)acrylate, ethyl(meth)acrylate, propyl(meth)acrylate, butyl(meth)acrylate, 2-ethylhexyl (meth)acrylate, dodecyl(meth)acrylate, hexadecyl(meth) acrylate, heptadecyl(meth)acrylate, and eicocyl(meth)acrylate), dialkyl malate (in which two alkyl groups are straight chained, branch chained, or cyclic chained groups and have 2 to 8 carbon atoms), poly(meth)aryloxyalkanes such as diaryloxyethane, triaryloxyethane, tetraaryloxyethane, tetraaryloxypropane, tetraaryloxybutane and tetrametharyloxyethane, vinyl based monomers having polyalkylene glycol chain such as polyethylene glycol (molecular weight: 300) mono(meth)acrylate, polypropylene glycol (molecular weight: 500) monoacrylate, adducts of (meth)acrylate with 10 mol of methylalcoholethyleneoxide, and adducts of (meth)acrylate with 30 mol of lauryl alcohol ethylene oxide), poly(meth)acrylates such as poly(meth)acrylates of polyhydroxyl alcohols (e.g., ethylene glycol di(meth)acrylate, propylene glycol di(meth)acrylate, neopentylglycol di(meth) acrylate, trimethylol propane tri(meth)acrylate, and polyethylene glycol di(meth)acrylate).

Vinyl(thio)ethers: vinylmethyl ether, vinylethyl ether, vinylpropyl ether, vinylbutyl ether, vinyl-2-ethylhexyl ether, vinylphneyl ether, vinyl-2-methoxyethyl ether, methoxy butadiene, vinyl-2-buthxyethyl ether, 3,4-dihydro-1,2-pyrane, 2-buthoxy-2'-vinyloxy diethyl ether, vinyl-2-ethylmercapto ethylether, acetoxystyrene and phenoxy styrene.

Vinyl ketones: vinyl methylketone, vinylethylketone, and vinyl phenylketone. Vinyl sulfone: divinyl sulfide, p-vinyl diphenyl sulfide, vinyl ethylsulfide, vinyl ethylsulfone, divinyl sulfone, and divinyl sulfoxide.

(9) Other Vinyl Based Monomer

Isocyanate ethyl(meth)acrylat, and m-isopropenyl-α,α-dimethylbenzyl isocyanate.

(10) Vinyl Based Monomer Having Fluorine Atom 4-fluorostyrene, 2,3,5,6-tetrafluorostyrene, pentafluorophenyl(meth)acrylate, pentafluorobenzyl(meth)acrylate, perfluorocyclohexyl(meth)acrylate, perfluorocyclohexylmethyl(meth)acrylate, 2,2,2-trifluoroethyl(meth)acrylate, 2,2,3,3-tetrafluoropropyl(meth)acrylate, 1H,1H,4H-hexafluorobutyl(meth)acrylate, 1H,1H,4H-hexafluorobutyl(meth) acrylate, 1H,1H,5H-ocatafluoropentyl(meth)acrylate, 1H,1H,7H-dodecafluoroheptyl(meth)acrylate, perflurooctyl (meth)acrylate, 2-perfluorooctylethyl(meth)acrylate, heptadecafluorodecyl(meth)acrylate, trihydroperfluoroundecyl (meth)acrylate, perfluoronorbonyl(meth)acrylate, 1H-perfluoroisobornyl(meth)acrylate, 2-(N-butylperfluorooctane sulfone amide)ethyl(meth)acrylate, 2-(N-ethylperfluorooctane sulfone amide)ethyl(meth)acrylate, and derivatives introduced from α-fluoroacrylic acid. Bis-hexafluoroiso propyl itaconate, bis-hexafluoro isopropyl malate, bis-perfluorcoctyl itaconate, bis-perfluorooctyl malate, bis-trifluoroethyl itaconate, and bis-trifluoroethyl malate. Vinylheptafluorobutylate, vinyl perfluoroheptanoate, vinyl perfluoro nonanoate and vinyl perflucro octanoate.

Vinyl Based Copolymer

As copolymers of a vinyl based monomer, copolymerized polymers formed of any two or more monomers of the compounds of (1) to (10) with an arbitral ratio can be used. Specific examples thereof include, but are not limited to, ester copolymers of styrene and (meth) acrylic acid, styrene-butadiene copolymers, ester copolymers of (meth)acrylic acid and acrylic acid, copolymers of styrene and acrylonitrile, copolymers of styrene and anhydride of malaic acid, copolymers of styrene and (meth)acrylic acid, copolymers of styrene and (meth)acrylic acid and divinyl benzene, and ester copolymers of styrene, styrene sulfonic acid and (meth)acrylic acid.

Vinyl Based Copolymer Resin Particulate

Vinyl based resin particulates are manufactured by a method in which the vinyl based copolymer resin mentioned above is dispersed in an aqueous medium, but easily manufactured by a typical emulsification polymerization, etc.

Coloring Agent

Suitable coloring agents (coloring material) for use in the toner of the present invention include known dyes and pigments. Specific examples of the coloring agents include, but are not limited to, carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials can be used alone or in combination. The content of the coloring agent is from 1 to 15% by weight and preferably from 3 to 10% by weight based on the toner.

In the present invention, a toner component containing a resin, a coloring agent, etc., is gradually added to an organic solvent while being stirred to obtain a solution or liquid dispersion as a method of preparing an oil phase in which a coloring agent is dissolved or dispersed together with a resin in an organic solvent. When a pigment is used as the coloring agent, the particle size thereof is preferably reduced prior to addition of the coloring agent. The coloring agent can be used as a master batch as described in Examples (which are described later).

Releasing Agent

Any known releasing agent can be included in the toner of the present invention. Suitable release agents include known waxes. Specific examples of the releasing agent (wax) include, but are not limited to, polyolefin waxes such as polyethylene waxes and polypropylene waxes; long chain hydrocarbons such as paraffin wax, Fischer-Tropsch wax and SAZOL wax; waxes including a carbonyl group.

Specific examples of the waxes including a carbonyl group include, but are not limited to, polyalkane acid esters such as carnauba wax, montan waxes, trimethylolpropane tribehenate, pentaerythritol tetrabehenate, pentaerythritol diacetate dibehenate, glycerin tribehenate, and 1-octadecanediol distearate; polyalkanol esters such as trimellitic acid tristearyl, and distearyl maleate; polyalkylamide such as trimellitic acid tristearylamide; dialkyl ketone such as distearyl ketone, etc. Among these, polyolefin waxes and long chain hydrocarbons are preferable in terms of the polar structure and the melt viscosity and paraffin wax and Fischer-Tropsch wax are particularly preferable External Additive Inorganic Particulate An external additive can be added to the toner of the present invention to help improving the fluidity, developability, chargeability of the coloring agent prepared or obtained in the present invention. Inorganic particulates are suitably used as such an external additive. The inorganic particulate preferably has a primary particle diameter of from 5 nm to 2 μm, and more preferably from 5 nm to 500 nm. In addition, the specific surface area of such inorganic particulates measured by the BET method is preferably from 20 to 500 $m^2/g$. The content ratio of such inorganic particulates is preferably from 0.01 to 5% by weight and particularly preferably from 0.01 to 2% by weight based on the weight of toner, Specific examples of the inorganic particulates include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Polymer Particulate

In addition, polymer particulates, such as polystyrene, methacrylate copolymers and acrylate copolymers, which are obtained by a soap-free emulsification polymerization, a suspension polymerization, or a dispersion polymerization, and polycondensation thermocuring resin particles, such as silicone, benzoguanamine and nylon, can be used.

Surface Treatment of External Additive

The fluidizers (external additives) specified above can be surface-treated to improve the hydrophobic property and prevent deterioration of the fluidity characteristics and chargeability in a high humidity environment. Preferred specific examples of surface treatment agents include, but are not limited to, silane coupling agents, silyl agents, silane coupling agents having a fluorine alkyl group, organic titanate coupling agents, aluminum-based coupling agents, silicone oil, and modified-silicone oil.

Cleaning Property Improver

As a cleaning property improver to remove a development agent remaining on an image bearing member or a primary transfer medium after transfer, stearic acid, aliphatic metal salts, for example, zinc stearate and calcium stearate, and polymer particulates manufactured by soap-free emulsification polymerization, such as polymethyl methacrylate particulates and polystyrene particulates, can be used. Such polymer particulates preferably have a relatively sharp particle size distribution and a volume average particle size of from 0.01 to 1 μm.

Method of Manufacturing Toner

The method of manufacturing the toner of the present invention is described below but is not limited thereto.

The toner of the present invention is prepared by dissolving or dispersing at least a resin containing a resin having a polyester skeleton and a vinyl based copolymer resin containing a releasing agent to obtain a lysate (liquid mixture) and/or a dispersion material of toner constituent, dispersing the lysate and/or the dispersion material in an aqueous medium to obtain a liquid dispersion and removing the organic solvent from the liquid dispersion.

The method is described in detail below.

Vinyl Based Copolymer Resin Containing Releasing Agent

The vinyl based copolymer resin containing a releasing agent represents a mixture of the vinyl based copolymer resin and the releasing agent in which a vinyl based copolymer resin and a releasing agent are physically mixed and not compatible in each other so that the characteristics of each are demonstrated upon application of heat and/or pressure.

Thus, the vinyl based copolymer resin containing a releasing agent for use in the present invention is different from a mixture in which a releasing agent and a vinyl based copolymer resin are chemically bonded.

The vinyl based copolymer resin particulate containing a releasing agent is formed of the releasing agent and the vinyl based copolymer resin in the particulate level.

However, not all the particulates contain the both components and thus particulates formed of only the releasing agent or the vinyl based copolymer resin are existent in some degree.

At least, the vinyl based copolymer resin particulates containing a releasing agent is not a material prepared by simply mixing separately prepared releasing agent particulates and vinyl based copolymer resin particulates.

The vinyl based copolymer resin particulate containing a releasing agent is manufactured by, for example, the following method.

The releasing agent is finely dispersed in water together with a surface active agent and then the vinyl based copolymerizable monomer is added followed by a typical emulsification polymerization.

The releasing agent can be dispersed by using, for example, bead mill, and preferably has a dispersion particle diameter of from 100 to 500 nm. In addition, the content ratio of the releasing agent is preferably from 20 to 30% by weight.

The vinyl based copolymerizable monomer may dissolve the releasing agent depending on a combination of the vinyl based copolymerizable monomer and the releasing agent, which is described later.

The particle diameter of the vinyl based copolymerizable particulate containing a releasing agent is controlled by the dispersion degree during emulsification polymerization and the kind and the quantity of an emulsifier and is from about 100 nm to about 2 μm, and preferably 200 nm or less. The vinyl based copolymerizable particulate containing a releasing agent having an excessively large particle diameter may worsen the particle size distribution of toner when the toner is prepared.

The resin particulate liquid dispersion can be used as is or dried when the toner is manufactured.

The content ratio of the releasing agent in the toner is from about 2 to about 6% by weight and the content of the vinyl based copolymer resin containing a releasing agent is determined according to this content ratio.

The content is eventually determined according to the target electrophotographic process but an excessive content ratio of the releasing agent in the toner easily causes trouble in the development process and other processes.

The endothermic amount of the releasing agent based on the melting heat thereof in the toner is preferably 10 mJ or less per mg of the toner depending on the kind of the releasing agent. This endothermic amount generally indicates the amount of wax (releasing agent) contained in toner when the wax is identified.

Since the vinyl based copolymerizable monomer is liquid, the releasing agent may be dissolved therein.

As the polymerization reaction proceeds, the vinyl based copolymers are produced and the dissolved releasing agent gradually precipitates.

Thus, the vinyl based copolymer resin containing a releasing agent exists in a state in which the releasing agent and the vinyl based copolymer resin are physically mingled.

Granulation Process of Toner

Organic Solvent

A volatile organic solvent having a boiling point lower than 100° C. is preferably used for granulation in terms of removal of the organic solvent performed later.

Specific examples the organic solvents include, but are not limited to, toluene, xylene, benzene, carbon tetrachloride, methylene chloride, 1,2-dichlcroethane, 1,1,2-trichloroethane, trichloroethylene, chloroform, monochlorobenzene, dichloroethylidene, methyl acetate, ethyl acetate, methylethyl ketone and methylisobuthyl ketone. These can be used alone or in combination. Among these, ester based solvents such as methyl acetate and ethyl acetate, aromatic based solvent such as toluene and xylene, and halogenized hydrocarbons such as methylene chloride, 1,2-dichloroethane, chloroform and carbon tetrachloride are especially preferred. The polyester resin, and the coloring agent can be simultaneously dissolved or dispersed but typically dissolved or dispersed in separate occasions. The organic solvent to dissolve or disperse each of the polyester resin, the coloring agent and the fixed surface protective agent can be the same or different but using the same organic solvent is preferable considering the subsequent solvent treatment.

In addition, when a solvent (simple or mixed) that suitably dissolves a polyester based resin is selected, the releasing agent preferably used in the present invention is not dissolved in the solvent because of the difference of the solubility between the polyester based resin and the releasing agent. In addition, the vinyl based copolymer resin is not dissolved much in the solvent, either. However, depending on the molecular weight and the polarity, the vinyl based copolymer resin may be dissolved or swollen in some degree.

Dissolution or Dispersion of Polyester Based Resin

The resin density in the solution or liquid dispersion of a polyester based resin is preferably from about 40 to about 80% by weight. A resin density that is too high tends to make dissolution or dispersion difficult and the viscosity high so that handling solution or liquid dispersion is difficult. When the resin density is too low, the amount of produced particulates tends to decrease, which means that the amount of the solvent to be removed increases. When a modified polyester resin having an isocyanate group at its end is mixed with a polyester based resin, the modified polyester resin and the polyester resin can be mixed in the same solvent or liquid dispersion or manufactured separately in different solvent or liquid dispersion. Considering the solubility and the viscosity thereof, using different solvent or liquid dispersion is preferable.

Aqueous Medium

Suitable aqueous media for use in the present invention include water, and a mixture of water with a solvent which is mixable with water. Specific examples of such a solvent include, but are not limited to, alcohols (e.g., methanol, isopropanol and ethylene glycol), dimethylformamide, tetrahydrofuran, cellosolves (e.g., methyl cellosolve), lower ketones (e.g., acetone and methyl ethyl ketone), etc. The amount of an aqueous medium is normally from 50 to 2,000 parts by weight and preferably from 100 to 1,000 parts by weight based on 100 parts by weight of resin particulates.

Inorganic Dispersion Agent and Organic Resin Particulate

The lysate and/or dispersion material of the polyester based resin and the releasing agent mentioned above is preferably dispersed in an aqueous medium in which an inorganic dispersion agent or organic resin particulates are preliminarily dispersed to have a sharp particle size distribution and stabilize the dispersion.

Specific examples of the inorganic dispersion agent include, but are not limited to, tricalcium phosphate, calcium carbonate, titanium oxide, colloidal silica and hydroxyapatite.

There is no specific limit to selection of the resin that forms resin particulates as long as the resin can form a dispersion body in an aqueous medium. A dispersion body having fine spherical resin particulates is preferred. Any thermoplastic resins or thermocuring resins can be used as resin particulates. Specific examples thereof include, but are not limited to, vinyl based resins, polyurethane resins, epoxy resins, polyester resins, polyamide resins, polyimide resins, silicon based resins, phenol resins, melamine resins, urea resins, aniline resins, ionomer resins, and polycarbonate resins. Among these, vinyl resins, polyurethane resins, epoxy resins and polyester resins and their combinational use are preferred in terms that an aqueous dispersion body having fine spherical resin particulates is easy to obtain.

Surface Active Agent

In addition, a surface active agent is optionally used when manufacturing the resin particulates mentioned above.

Specific examples of the surface active agents include, but are not limited to, anionic dispersion agents, for example, alkylbenzene sulfonic acid salts, α-olefin sulfonic acid salts, and phosphoric acid salts; cationic dispersion agents, for example, amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic dispersion agents, for example, fatty acid amide derivatives, polyhydric alcohol derivatives; and ampholytic dispersion agents, for example, alanine, dodecyldi(aminoethyl) glycin, di(octylaminoethyle)glycin, and N-alkyl-N,N-dimethylammonium betaine. An extremely small amount of a surface active agent having a fluoroalkyl group is effective for a good dispersion. Preferred specific examples of the anionic surface active agents having a fluoroalkyl group include, but are not limited to, fluoroalkyl carboxylic acids having from 2 to 10 carbon atoms and their metal salts, disodium perfluorooctanesulfonylglutamate, sodium 3-{omega-fluoroalkyl (C6-C11)oxy}-1-alkyl(C3-C4)sulfonate, sodium 3-{omega-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16)ethylphosphates, etc. Specific examples of the cationic surface active agents having a fluorcalkyl group include, but are not limited to, primary and secondary aliphatic amino acids, secondary amino acids, aliphatic quaternary ammonium salts (for example, perfluoroalkyl(C6-C10)sulfoneamidepropyltrimethyl ammonium salts), benzalkonium salts, benzetonium chloride, pyridinium salts, and imidazolinium salts.

Protection Colloid

Liquid droplet dispersion can be stabilized in an aqueous medium by using a polymer protection colloid.

Specific examples of such polymeric protection colloids include, but are not limited to, polymers and copolymers prepared using monomers, for example, acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or a heterocyclic ring having a nitrogen atom (e.g., vinyl pyridine, vinyl pyrrolidone, vinyl imidazole and ethylene imine). In addition, polymers, for example, polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters), and cellulose compounds, for example, methyl cellulose, hydroxyethyl cellulose and hydroxypropyl cellulose, can also be used as the polymeric protection colloid. When compounds, for example, calcium phosphate, which are soluble in an acid or alkali, are used as a dispersion stabilizer, it is possible to dissolve the calcium phosphate by adding an acid, for example, hydrochloric acid, followed by washing of the resultant particles with water, to remove the calcium phosphate from the particulates. In addition, a zymolytic method can be used to remove such compounds. Such a dispersion agent may remain on the surface of toner particles. However, the dispersion agent is preferably washed and removed in terms of the charging property of toner particles.

Dispersion Method

There is no particular limit to the dispersion method. Low speed shearing methods, high speed shearing methods, friction methods, high pressure jet methods, ultrasonic methods, etc., can preferably be used. When a high speed shearing type dispersion machine is used, there is no particular limit to the rotation speed thereof, but the rotation speed is typically from 1,000 to 30,000 rpm, and preferably from 5,000 to 20,000 rpm. The temperature during the dispersion process is typically from 0 to 150° C. (under pressure), and preferably from 20 to 80° C.

Solvent Removal

Any known method can be used to remove an organic solvent from the obtained emulsified dispersion body. For example, a method can be employed in which the system is gradually heated under normal pressure or with a reduced pressure to completely evaporate and remove an organic solvent in the droplets.

Elongation and/or Cross Linking Reaction

When a modified polyester resin having an isocyanate group at its end and an amine reactive therewith are added to introduce a modified polyester resin having a urethane and/or a urea linkage, the amine can be mixed in an oil phase before a toner component is dispersed in an aqueous medium or added to the aqueous medium. The reaction time is determined depending on the isocyanate group structure included in a polyester prepolymer and the reactivity thereof with the added amine and is typically from 1 minute to 40 hours and preferably from 1 to 24 hours. The reaction temperature is from 0 to 150° C. and preferably from 20 to 98° C.

Washing and Drying Process

Known technologies are used in the process of washing and drying toner particles dispersed in an aqueous medium. That is, after solid and liquid of an aqueous medium are separated by a centrifugal or a filter press to obtain a toner cake, the obtained cake is re-dispersed in de-ionized water at room temperature to about 40° C. Subsequent to optional pH adjustment by an acid or an alkali, the resultant is subject to the solid and liquid separation treatment again. This cycle is repeated several times to remove impurities and the active surface agent. Thereafter, the resultant is dried by an air stream drier, a circulation drier, a reduced pressure drier, a vibration flow drier, etc. to obtain toner powder. Toner particulate component can be removed by a centrifugal or a known classifier can be optionally used after the drying process to obtain a toner having a desired particle size distribution.

External Addition Treatment

The thus prepared mother toner particles after the drying process can be mixed with other particles such as the charge control agent particulates and fluidizing agent particulates. Such other particles can be fixed to the toner particles by applying a mechanical impact thereto to integrate the particles into the toner particles. Thus, the other particles can be prevented from being detached from the toner particles.

Specific examples of such mechanical impact application methods include, but are not limited to, methods in which a mixture is mixed by a blade rotating at a high speed and methods in which a mixture is put into a jet air to collide the particles against each other or a collision plate.

Specific examples of such mechanical impact applicators include, but are not limited to, ONG MILL (manufactured by Hosokawa Micron Co., Ltd.), modified I TYPE MILL (manufactured by Nippon Pneumatic Mfg. Co., Ltd.) in which the pressure of pulverization air is reduced, HYBRIDIZATION SYSTEM (manufactured by Nara Machine Co., Ltd.), KRYPTRON SYSTEM (manufactured by Kawasaki Heavy Industries, Ltd.), automatic mortars, etc.

Image Formation Method, Image Forming Apparatus and Process Cartridge

Image Forming Apparatus and Process Cartridge

The image forming apparatus for use in the present invention uses the toner of the present invention to form images.

The toner of the present invention can be used as a single component development agent or a two component development agent but is preferably used as a single component development agent.

In addition, the image forming apparatus for use in the present invention preferably has an endless intermediate transfer device.

Furthermore, the image forming apparatus for use in the present invention includes an image bearing member, and preferably a cleaning device that removes toner remaining on the image bearing member and/or the intermediate transfer device. The cleaning device optionally has a cleaning blade.

In addition, the image forming apparatus for use in the present invention preferably includes a fixing device that fixes an image with a roller or belt having a heating device.

In addition, the image forming apparatus for use in the present invention preferably has a fixing device that dispenses with oil application to the fixing member.

Furthermore, the image forming apparatus for use in the present invention preferably includes other suitably selected devices such as a discharging device, a recycling device, and a control device.

The image forming apparatus for use in the present invention may have a structure including a process cartridge formed of elements such as an image bearing member, a development device, and a cleaning device. The process cartridge is detachably attachable to the image forming apparatus.

In addition, a process cartridge formed of an image bearing member and at least one of the devices of a charging device, an irradiation device, a development device, a transfer device, a separation device, and a cleaning device supported together with the image bearing member. The process cartridge is structured to be a single unit detachably attachable to the image forming apparatus by a guiding device such as a rail provided therein.

The image forming apparatus includes an image bearing member that is driven to rotate clockwise contained in a case (not shown), and other devices provided around the image bearing member 1 such as charging device 2, an irradiation device 3, a development device 4 accommodating the toner T of the present invention, a cleaning unit 5, an intermediate transfer body 6, a support roller 7, a transfer roller 8, and a discharging roller (not shown).

This image forming apparatus includes a paper cassette (not shown) accommodating multiple sheets of recording paper P as a recording medium. The recording paper P in the paper cassette is transferred one sheet by one sheet between the transfer roller 8 functioning as a transfer device and the intermediate transfer body 6 after adjusting the timing at a pair of registration rollers (not shown).

Figure 2:
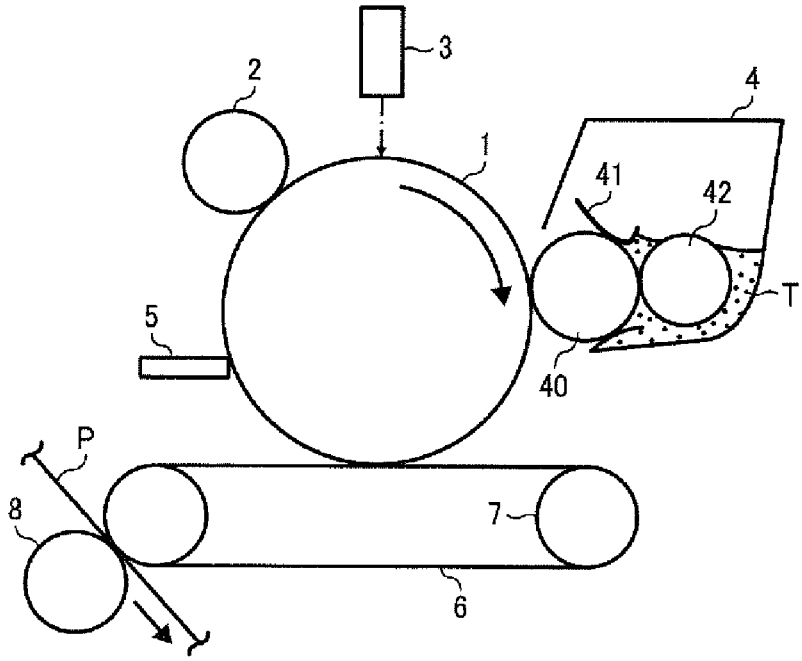
FIG. 2 is a diagram illustrating an embodiment of an image forming apparatus using the toner of the present invention.

The image forming apparatus drives the image bearing member 1 to rotate clockwise in FIG. 2; uniformly charges the image bearing member 1 with the charging device 2; then irradiates the image bearing member 1 with a laser beam modulated according to image data by the irradiation device to form a latent electrostatic image on the image bearing member 1; and attaches the toner T to the image bearing member 1 by the development device 4 to develop the latent electrostatic image.

Next, the toner image on the image bearing member 1 formed by the development device 4 is transferred to the intermediate transfer body 6 by a transfer bias applied thereto and transferred to the recording paper P fed between the intermediate transfer body 6 and the transfer roller 8.

Furthermore, the recording paper P on which the toner image is transferred is conveyed to the fixing device (not shown).

The fixing device includes a fixing roller that is heated to a predetermined fixing temperature by a built-in heater and a pressure roller pressed against the fixing roller with a predetermined pressure to apply heat and pressure to the recording paper P to fix the toner image thereon. Thereafter, the recording paper P is discharged to a paper discharging tray (not shown).

On the other hand, the image forming apparatus further rotates the image bearing member 1 from which the toner image is transferred to the recording paper P by the transfer roller 8 to scrape off the toner T remaining on the surface of the image bearing member 1 at the cleaning unit 5 and discharges the image bearing member 1 by the discharging device (not shown).

The image forming apparatus uniformly charges the image bearing member 1 discharged by the discharging device with the charging device 2 to be ready for the next image formation.

Each member or device suitably used for the image forming apparatus for use in the present invention is fully described.

There is no specific limit to the image bearing member 1 with regard to the material, form, structure and the size thereof and any known image bearing member can be used and suitably selected. The image bearing member 1 suitably employs a drum form or a belt form. Also, an inorganic image bearing member formed of amorphous silicon or selenium or an organic image bearing member formed of polysilane, or phthalopolymethine is suitably used. Among these, amorphous silicon or an organic image photoconductor (image bearing member) is preferred in terms of long working life. A latent electrostatic image can be formed on the image bearing member 1 by, for example, charging the surface of the image bearing member 1 followed by irradiation according to image data with a latent electrostatic image formation device.

The latent electrostatic image formation device includes, for example, the charging device 2 that charges the surface of the image bearing member 1 and the irradiation device 3 that irradiates the surface of the image bearing member 1 with light according to the image data.

The charging process is performed by, for example, applying a voltage to the surface of the image bearing member 1 with the charging device 2. Any charging device can be selected as the charging device 2. For example, a known contact type charging device having an electroconductive or semi-conductive roller, brush, film, or rubber blade or a known non-contact type charging device such as corotron, or scrotron using the corona discharging are suitably used.

The charging device 2 can employ a form of a magnetic brush, or a fur brush in addition to a roller and be selected according to the specification or structure of the electrophotographic apparatus.

When a magnetic brush is used, the magnet brush uses a charging member formed of, for example, ferrite particles such as Zn—Cu ferrite, a non-magnetic electroconductive sleeve that supports the charging member, and a magnet roller provided inside the sleeve.

In addition, when a brush is used, material such as carbon, copper sulfate, fur electroconductively treated by metal or metal oxide, is used. The brush is formed by winding or attaching such material to metal or electroconductively treated metal core.

The charging device 2 is not limited to the contact type charging device specified above but which is preferable to manufacture an image forming apparatus having a charging device producing less amount of ozone.

Irradiation is performed by, for example, irradiating the surface of the image bearing member 1 with the irradiation device 3 according to image data.

Any irradiation device that can irradiate the surface of the image bearing member 1 charged by the charging device 2 according to image data is suitably used. Specific examples of such irradiation devices include, but are not limited to, various kinds of irradiation devices of a photocopying optical system, a rod lens array system, a laser optical system, or a liquid crystal shutter optical system.

Development is performed by, for example, developing a latent electrostatic image with the toner 1 of the present invention with the development device 4.

Any known development device that can perform development with the toner of the present invention is suitably selected. For example, a development device that accommodates the toner of the present invention and includes a development unit which imparts the toner to the latent electrostatic image in a contact or non-contact manner can be suitably used.

The development device 4 preferably has a development roller 40 that rotates in contact with the image bearing member 1 while bearing toner on the circumference surface and supplies the toner to a latent electrostatic image formed on the image bearing member 1, and a thin layer formation member 41 that thin-regulates the layer of the toner on the development roller 40 while in contact with the circumference surface of the development roller 40. A metal roller or an elastic roller is suitably used as the development roller 40. Any metal roller is suitably selected and used. An example thereof is an aluminum roller. A metal roller having an arbitrary surface friction coefficient used as the development roller 40 is easily manufactured by blast treatment. To be specific, an aluminum roller subject to glass bead blast treatment to form a coarse surface to which a suitable amount of toner is attached is suitably used as the development roller 40. A roller covered by an elastic rubber layer is further covered by a surface coating layer formed of material easily charged with a polarity reverse to that of the toner. The elastic rubber layer is set to have a hardness of 60 degree or less according to JIS-A to prevent toner deterioration caused by the concentration of pressure at the contact portion with the thin layer formation member 41. The surface roughness Ra is set to be from 0.3 to 2.0 μm to hold a suitable amount of toner on the surface.

In addition, a development bias is applied between the development roller 40 and the image bearing member 1 to generate an electric field. Therefore, the elastic rubber layer is set to have a resistance of from $10^3$ to $10^{10}\Omega$. The development roller 40 rotates clockwise and transfers the toner borne on the surface to the opposing position between the thin layer formation member 41 and the image bearing member 1.

The thin layer formation member 41 is located at a position below the contact portion of a supply roller 41 and the development roller 40. The thin layer formation 41 has a free end brought into contact with the surface of the development roller 40 by using a metal board spring formed of stainless steel (SUS), phosphorous bronze under a pressure of from 10 to 40 N/m. The toner is thin-layered and triboelectrically charged while passing through this pressure. Furthermore, a regulation bias having an offset value to the development bias in the same direction as the charging polarity of the toner is applied to the thin layer formation member 41 to assist the triboelectric charging.

Any known rubber elastic material that forms the surface of the development roller 40 can be selected and used. Specific examples thereof include, but are not limited to, styrene-butadiene based copolymer rubber, acrylonitrile-butadiene based copolymer rubber, acryl rubber, epichlorohydrine rubber, urethane rubber, silicone rubber, or blend rubber thereof. Among these, blend rubber of epichlorohydrine rubber, and acrylonitrile-butadiene based copolymer rubber is particularly preferable. The development roller 40 is manufactured by covering the outer circumference of an electroconductive shaft with rubber elastic material. The electroconductive shaft is formed by metal such as stainless steel (SUS).

The transfer is performed by a transfer roller by, for example, charging the image bearing member 1.

The transfer roller preferably has a structure including a primary transfer device that transfers a toner image to the intermediate transfer body 6 to form a transfer image thereon and a secondary transfer device (transfer roller 8) that transfers the transfer image to the recording paper P.

A more preferable structure of the transfer roller includes a primary transfer device that transfers an at least two dolor or preferably full color toner image to the intermediate transfer body 6 to form a complex transfer image and a secondary transfer device (transfer roller 8) that transfers the complex transfer image to the recording paper P. Any known transfer body is suitably selected and used as the intermediate transfer belt 6. For example, a transfer belt is suitably used.

The transfer device (the primary transfer device and the secondary transfer device) preferably has a transfer unit that peels off and charges the toner image formed on the image bearing member 1 to the side of the recording paper P.

Two or more transfer devices can be provided. Specific examples of the transfer device include, but are not limited to, a corona transfer device using corona discharging, a transfer belt, a transfer belt, a transfer roller, a pressure transfer roller and an adhesive transfer device. A typical example of the recording paper P is plain paper but any paper to which a non-fixed image after development is transferred can be suitably used. PET base for an overhead projector can be also used. A toner image transferred to the recording paper P is fixed by a fixing device. Fixing can be performed every time each color toner image is transferred or at one time for a multi-color overlapped image. Any fixing device can be suitably selected. Any known heating and pressure device can be used. A combination of a heating roller and a pressure roller and a combination of a heating roller, a pressure roller and an endless belt can be used as the heating and pressure device. The heating temperature by the heating and pressure device is preferably from 80 to 200° C.

Figure 3:
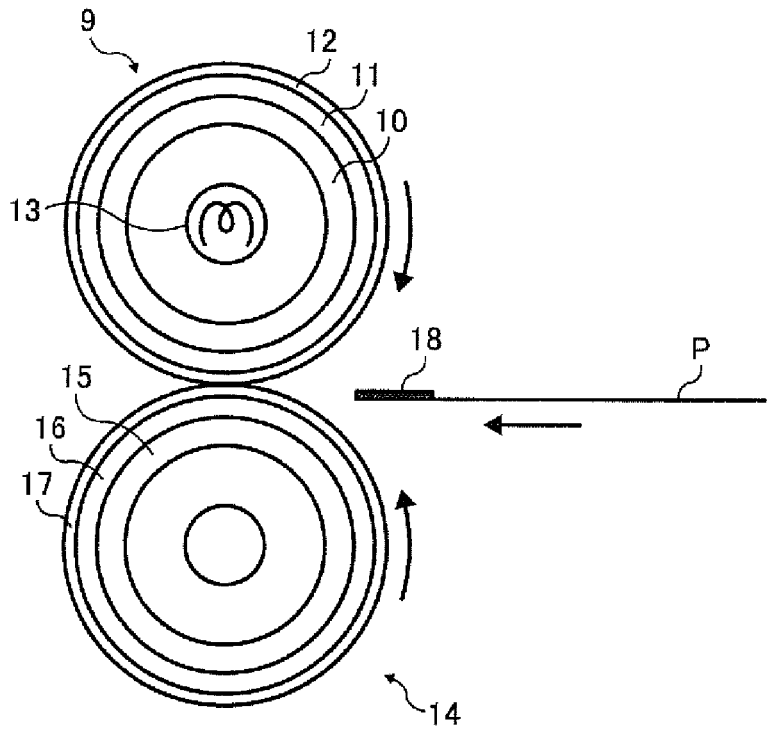
FIG. 3 is a diagram illustrating an embodiment of a fixing device for use in the e forming apparatus using the toner of the present invention.

A fixing device of a soft roller type having a structure formed of fluorine based surface layer agent as illustrated in FIG. 3 can be used. This fixing device includes a heating roller 9 formed of an aluminum core 10 on which an elastic layer 11 formed of silicone rubber, and a surface layer 12 formed of PFA (copolymer of tetrafluoroethylene-perfluoroalkyl vinyl ether) are provided, and a heater 13 provided inside the aluminum core. The fixing device also includes a pressure roller 14 including an aluminum core 15 on which an elastic layer 16 formed of silicone rubber and a surface layer 17 formed of PFA are provided. The recording paper P on which a non-fixed image 18 is printed passes through the fixing device. In the present invention, an optical fixing device, etc. can be used together with or instead of the fixing device. The image bearing member 1 is discharged by, for example, applying a discharging bias thereto by a discharging device. Any known discharging device that can apply a discharging bias to an image bearing member is suitably selected and used. For example, a discharging lamp is suitably used.

The toner remaining on the surface of the image bearing member is suitably cleaned by, for example, removing the toner therefrom by a cleaning device. Any known cleaning device that can remove the toner remaining on the surface of the image bearing member can be suitably selected and used. For example, a magnetic brush cleaner, an electrostatic brush cleaner, a blade cleaner, a brush cleaner, and a web cleaner can be preferably used.

Toner can be recycled for use by, for example, transferring the toner removed by the cleaning device to the development device by a recycling device. Any known recycling device can be suitably selected and used.

Each member can be suitably controlled by, for example, a control device. Any control device that can control each device or member is suitably selected and used. For example, devices such as a sequencer, and a computer can be used.

The image forming apparatus, the image formation method and the process cartridge of the present invention produce quality images by using a toner having excellent fixing property, and free from deterioration such as cracking ascribable to stress in the development process.

Multiple Color Image Forming Apparatus

Figure 4:
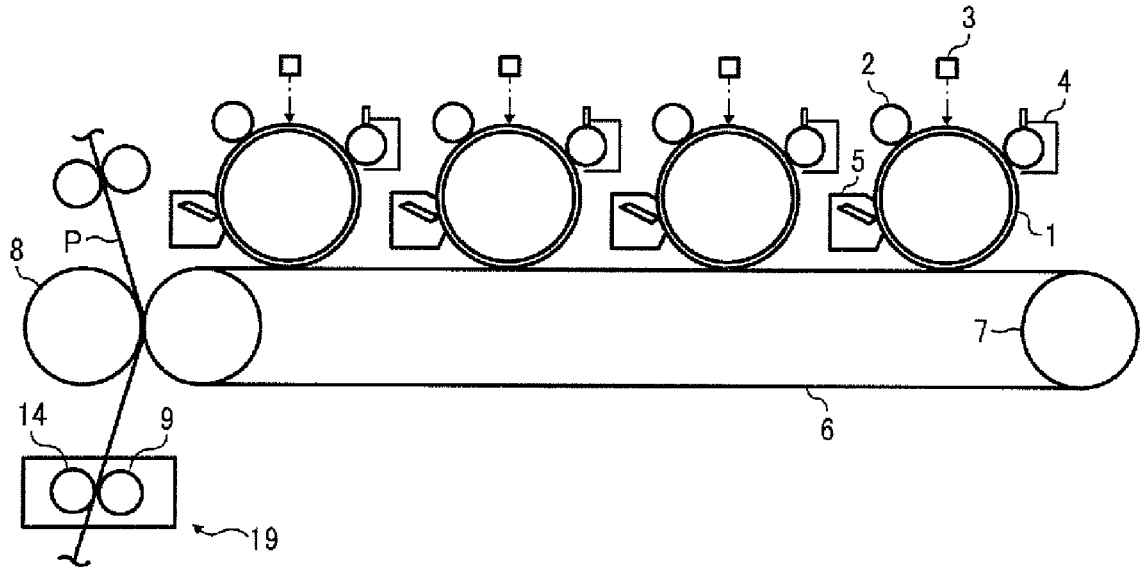
FIG. 4 is a diagram illustrating another embodiment of an image forming apparatus using the toner of the present invention.

FIG. 4 is a schematic diagram illustrating an example of the multiple color image forming apparatus to which the present invention is applied. FIG. 4 is a diagram illustrating tandem type full color image forming apparatus.

The image forming apparatus illustrated in FIG. 4 includes an image bearing member that is driven to rotate clockwise provided in a case (not shown), and other devices provided around the image bearing member 1 such as charging device 2, an irradiation device 3, a development device 4, an intermediate transfer body 6, a support roller 7, and a transfer roller 8.

This image forming apparatus includes a paper cassette (not shown) accommodating multiple sheets of recording paper P as recording media. The recording paper P in the paper cassette is transferred one sheet by one sheet between the transfer roller 8 and the intermediate transfer body 6 after adjusting the timing at a pair of registration rollers (not shown) and fixed by a fixing device 19.

Figure 5:
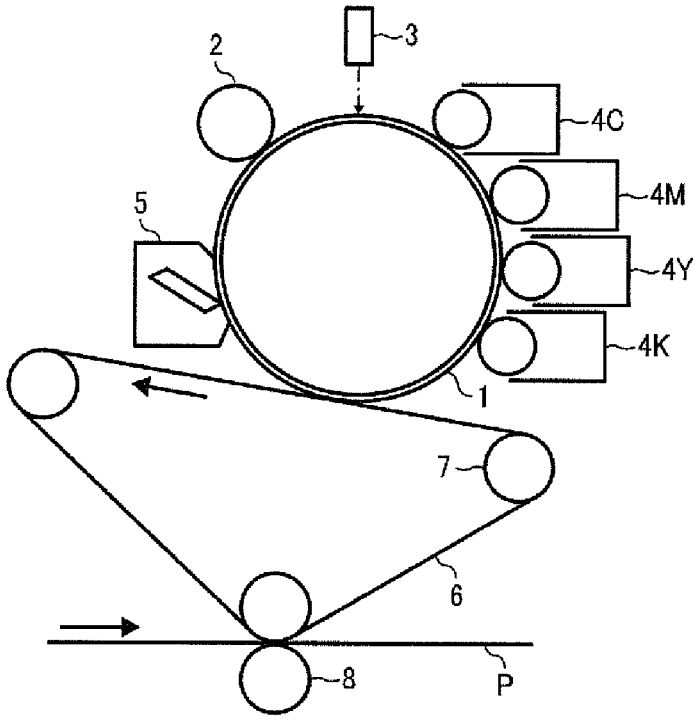
FIG. 5 is a diagram illustrating yet another embodiment of an image forming apparatus using the toner of the present invention.

The image forming apparatus drives and rotates the image bearing member 1 clockwise in FIG. 4; uniformly charges the image bearing member 1 with the charging device 2; then irradiates the image bearing member 1 with a laser beam modulated according to image data by the irradiation device to form a latent electrostatic image on the image bearing member 1; and attaches the toner T to the image bearing member 1 by the development device 4 to develop the latent electrostatic image. The image forming apparatus transfers a toner image formed by attaching toner to the image bearing member 1 by the development device 4 to the intermediate transfer body 6. This process is performed for the four colors of yellow, magenta (M), cyan (C), and black (K) to form a full color toner image. FIG. 5 is a schematic diagram illustrating an example of the full color image forming apparatus of a revolving type.

This image forming apparatus sequentially develops multiple color toner images on one image bearing member by switching operation of the development device. The transfer roller 8 transfers a color toner image on the intermediate transfer body 6 to the recording paper P and conveys the recording paper P to which the color toner image is transferred to obtain a fixed image.

On the other hand, the image forming apparatus further rotates the image bearing member 1 from which the toner image is transferred to the recording paper P by the intermediate transfer body 6 to scrape off the toner remaining on the surface of the image bearing member 1 at the cleaning unit 5, and discharges the image bearing member 1 by the discharging device (not shown).

The image forming apparatus uniformly charges the image bearing member 1 discharged by the discharging device with the charging device 2 to be ready for the next image formation.

The cleaning unit 5 is not limited to a device that scrapes off the residual toner on the image bearing member with a blade. For, example, a fur brush that scrapes off the residual toner on the image bearing member can be suitably used.

The image forming apparatus and the image formation method of the present invention use the toner of the present invention as the development agent and thus produce quality images.

Process Cartridge

The process cartridge of the present invention is detachably attachable to an image forming apparatus and includes an image bearing member that bears a latent electrostatic image, a development device that develops the latent electrostatic image borne on the image bearing member with the toner of the present invention to obtain a visualized image and other optional devices such as a charging device, a transfer device, a cleaning device, and a discharging device.

The development device includes a development agent container accommodating the toner or a development agent containing the toner, a development agent bearing member that bears and transfers the toner or the development agent accommodated in the development agent container and other optional devices such as a layer thickness regulation member that regulates the layer thickness of the toner borne on the development agent bearing member.

The process cartridge of the present invention is detachably attachable to various kinds of electrophotographic apparatuses, facsimile machines, printers and preferably the image forming apparatus of the present invention.

Figure 6:
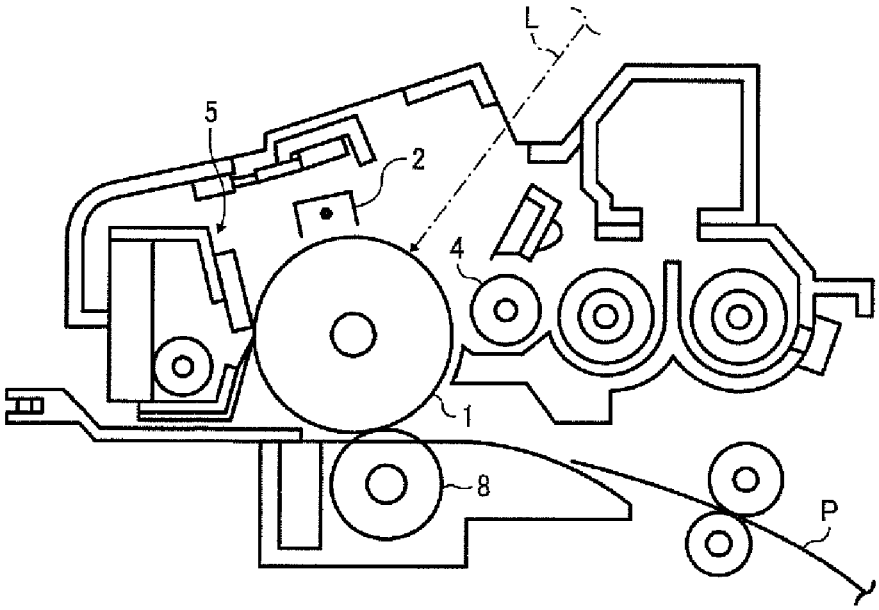
FIG. 6 is a diagram illustrating an example of the process cartridge of the present invention using the toner of the present invention.

The process cartridge includes, for example, the image bearing member 1, the charging device 2, the development agent 4, the transfer roller 8, the cleaning unit 5, and other optional devices as illustrated in FIG. 6.

In FIG. 6, L represents a beam from an irradiation device and P represents recording paper. Any image bearing member similar to that in the image forming apparatus described above can be used as the image bearing member 1. Any charging member can be used as the charging device 2.

Next, the image formation process by the process cartridge illustrated in FIG. 6 is described. The image bearing member 1 is charged by the charging device 2, and irradiated with a beam L by an irradiation device (not shown) while rotating in the direction indicated by an arrow to form a latent electrostatic image corresponding to the irradiation image on the surface of the image bearing member 1. This latent electrostatic image is developed with toner by the development device 4 and the obtained toner image is transferred by the transfer roller 8 to the recording paper P and printed out. The surface of the image bearing member 1 after image transfer is cleaned by the cleaning unit 5 and discharged by a discharging device (not shown) to be ready for the next image formation process.

Having generally described (preferred embodiments of) this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

First, the analysis method and evaluation method about the toner obtained in Examples and Comparative Examples are described.

The toner of the present invention used as a single component development agent is evaluated. However, the toner of the present invention can be used as a two component development agent by using the toner together with a suitable carrier by suitable external treatment.

Measuring Method

Particle Diameter

The method of measuring the particle size distribution of the toner particles is described next.

The particle size distribution of the toner particles can be measured by Coulter Counter method, etc. For example, Coulter Counter TA-II and Coulter Multisizer II (both are manufactured by Beckman Coulter, Inc.) can be used as the measuring instrument.

The measuring method is as follows.

First, add 0.1 to 5 ml of a surface active agent (preferably alkyl benzene sulfonate salt) as a dispersant to 100 to 150 ml of an electrolytic aqueous solution, which is about 1% NaCl aqueous solution prepared by using primary NaCl and pure water, for example, ISOTON-II (manufactured by Beckman Coulter, Inc.) can be used; Add 2 to 20 mg of a measuring sample of solidified toner to the electrolytic aqueous solution; Conduct dispersion treatment for the electrolytic aqueous solution in which the measuring sample is dispersed for about 1 to about 3 minutes by an ultrasonic dispersion device; Measure the volume and the number of the toner particles or the toner by the equipment mentioned above with an aperture of 100 μm; and calculate the volume distribution and the number distribution. The weight average particle diameter (Dv) and the number average particle diameter (Dp) of the toner can be obtained based on the obtained distributions.

The whole range is a particle diameter of from 2.00 to less than 40.30 μm and the number of the channels is 13. Each channel is: from 2.00 to not greater than 2.52 μm; from 2.52 to not greater than 3.17 μm; from 3.17 to not greater than 4.00 μm; from 4.00 to not greater than 5.04 μm; from 5.04 to not greater than 6.35 μm; from 6.35 to not greater than 8.00 μm; from 8.00 to not greater than 10.08 μm; from 10.08 to not greater than 12.70 μm; from 12.70 to not greater than 16.00 μm, from 16.00 to not greater than 20.20 μm; from 20.20 to not greater than 25.40 μm; from 25.40 to not greater than 32.00 μm; and from 32.00 to less than 40.30 μm.

Average Circularity

An optical detection method can be used for measuring particle forms in which particle images are optically detected and analyzed by a charge coupled device (CCD) camera while a suspension containing particles passes through an imaging detective portion having a plate form.

The average circularity of the particle is obtained by dividing the circumferential length of the circle having the area equal to a projected toner area with the circumferential length of the projected toner area. This value is a value measured by a flow type particle image analyzer FPIA-2100 as the average circularity. The specific procedure for obtaining the average circularity is as follows: (1) A surface active agent serving as a dispersion agent, preferably 0.1 to 5 ml of an alkylbenzenesulfonic acid salt, is added to 100 to 150 ml of water from which solid impurities have been preliminarily removed; (2) About 0.1 to about 0.5 g of a sample to be measured is added into the mixture prepared in (1); The prepared mixture in (2) is subjected to an ultrasonic dispersion treatment for about 1 to about 3 minutes such that the concentration of the particles is 3,000 to 10,000 particles per micro litter; and the form and average particle diameter distribution of the sample are measured by the instrument mentioned above.

Volume Average Particle Diameter of Resin Particulate

The volume average particle diameter of resin particulates can be measured by a nano track particle size distribution measuring device (UPA-EX150, manufactured by Nikkiso Co., Ltd.) based on a dynamic light scattering method or a laser Doppler method.

To be specific, a liquid dispersion in which resin particulates are dispersed is adjusted to be in the measuring density range before measurement. At the same time, just the solvent of the liquid dispersion is measured for background measurement. The range of from several tens nm to several μm, which is the volume average particle diameter of the resin particulates for use in the present invention, is measureable according to this measuring method.

Molecular Weight

The molecular weight of the polyester resin or the vinyl based copolymer resins for use in the present invention is measured by a typical gel permeation chromatography under the following conditions:

Instrument: HLC-8220 GPC (manufactured by Tosoh Corporation)

Column: TSK gel Super HZM-M×3

Temperature: 40° C.

Solvent: tetrahydrofuran (THF)

Flow speed: 0.35 ml/minute

Sample: Density: Inject 0.01 ml of sample having a density of from 0.05 to 0.6%

The weight average molecular weight Mw is calculated by using the molecular weight calibration curve made based on a simple dispersion polystyrene standard sample from the molecular weight distribution of the toner resin measured under the conditions specified above.

The simple dispersion polystyrene standard samples are the following ten samples: 5.8×100, 1.085×10,000, 5.95×10,000, 3.2×100,000, 2.56×1,000,000, 2.93×1,000, 2.85×10,000, 1.48×100,000, 8.417×100,000 and 7.5×1,000,000.

Glass Transition Temperature and Endothermic Amount

Figure 7:
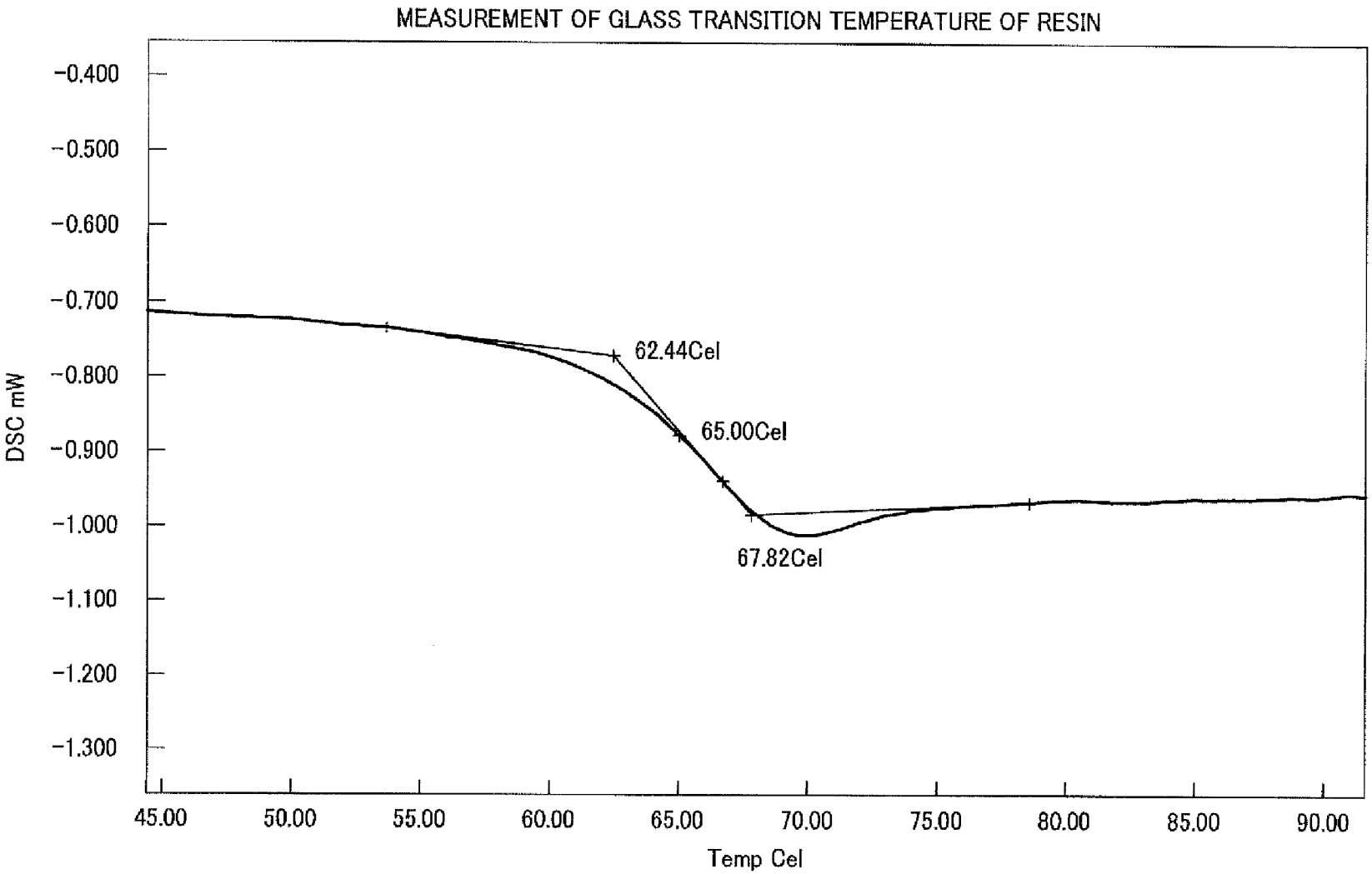
FIG. 7 is a graph illustrating an measurement example of the glass transition temperature of a resin.

The glass transition temperature (Tg) of the polyester resin and the vinyl based copolymer resin can be measured by using, for example, a differential scanning calorimeter (e.g., DSC-6220R, manufactured by Seiko Instruments Inc.) in the following manner: Heat a sample from room temperature to 150° C. at a temperature rise speed of 10° C./min; Leave the sample at 150° C. for 10 minutes; Cool down the sample to the room temperature at a temperature decline speed of 10° C./min; Leave the sample at the room temperature for 10 minutes; and heat the sample again to 150° C. at a temperature rise speed of 10° C./min. The glass transition temperature is obtained as the half (middle) point between the base line (significant straight line) above the glass transition temperature and the base line (significant straight line) below the glass transition temperature (refer to FIG. 7).

In addition, the endothermic amount of the releasing agent, etc, can be measured in the same manner. The endothermic amount is obtained by calculating the peak area of the measured endothermic peak.

In general, a releasing agent existent inside the toner is melted at a temperature lower than the fixing temperature and the melting heat at the time demonstrates the endothermic peak. In addition, some releasing agents have phase transition heat by the phase transition at the solid phase in addition to the melting heat. In the present invention, the total of both heats is defined as the endothermic amount of the melting heat.

Evaluation Method

Anti-stress Property

A predetermined printed pattern having a B/W ratio of 6% is continuously printed with an externally addition treated toner in an N/N environment (23° C. and 45%) using ipsio CX 2500 (manufactured by Ricoh Co. Ltd.) After a run length of 2,000 sheets in the N/N environment, the toner on the development roller while printing a white pattern is suctioned to measure the amount of charge by an electrometer. The difference of the amount of charge between 50 sheet printing and 2,000 sheet printing is evaluated.

E (Excellent): Absolute difference of the amount of charge is 5 μC/g or less

G (Good): Absolute value difference of the amount of charge is greater then 5 to 10 μC/g.

F (Fair): Absolute difference of the amount of charge is greater then 10 to 15 μC/g.

Bad (Bad): Absolute difference of the amount of charge is greater than 15 μC/g

Fixing Separability

An unfixed solid image having a width of 36 mm is printed at 3 mm from the front end of an A4 sheet by ipsio CX 2500 (manufactured by Ricoh Co. Ltd.) with an externally addition treated toner (development agent) with an attachment amount of 11 g/m$^2$.

This unfixed image is fixed by using the following fixing device in the temperature range of from 115 to 175° C. with a gap of 10° C. to obtain separable and non-offset temperature range. The temperature range represents the fixing temperature range in which the sheet is suitably separated from the heating roller without causing an offset phenomenon. The paper and the paper feed direction are 45 g/m$^2$ paper perpendicular to the machine direction, which are disadvantageous in terms of separability. The circumferential speed of the fixing device is set to be 200 mm/sec. The fixing device of a soft roller type having a structure formed of fluorine based surface layer agent as illustrated in FIG. 3 is used. To be specific, this fixing device includes a heating roller 9 formed of an aluminum core having an outer diameter of 40 mm on which an elastic layer 1 having a thickness of 1.5 mm formed of silicone rubber, and a surface layer 12 formed of PFA (copolymer of tetrafluoroethylene-perfluoroalkyl vinyl ether) are provided and a heater 13 provided inside the aluminum core. The fixing device also includes a pressure roller 14 including an aluminum core 15 having an outer diameter of 40 mm on which an elastic layer 1 having a thickness of 1.5 mm formed of silicone rubber and a surface layer 17 formed of PFA are provided. The recording paper P on which a non-fixed image 18 is printed passes through the fixing device.

E (Excellent): fixed image separable and non-offset in the range of from 115 to 175° C. and sufficiently durable.

G (Good): fixed image separable and non-offset in the range of from 115 to 175° C. but easily peeled or damaged by scraping or friction in the low temperature range.

F (fair): fixed image separable with non-offset phenomenon in the temperature range of from 30 to lower than 50° C.

B (bad): fixed image separable with non-offset phenomenon at a temperature lower than 30° C.

High Temperature Preservability

The toner is preserved at 55° C. for 8 hours and thereafter screened with a sieve having a 42 mesh for 2 minutes and the remaining ratio of the toner on the wire screen is determined as an indicator of the high temperature preservability. The toner is evaluated and ranked into 4 levels for the high temperature preservability.

E (Excellent): less than 10%

G (Good): 10 to 20%

F (Fair): 20 to 30% B (Bad): 30 or higher

Next, the preparation method of toner material for use in Examples is described.

Synthesis of Polyester

Polyester 1

The following components are placed in a container equipped with a condenser, a stirrer and a nitrogen introducing tube to conduct a reaction at 230° C. at normal pressure for 8 hours followed by another reaction for 5 hours with a reduced pressure of 10 to 15 mmHg and 26 parts by weight of trimellitic anhydride is added to the reaction container to conduct a reaction at 180° C. at normal pressure for 2 hours to obtain [Polyester 1].

| | |
|---|---|
| Adduct of bisphenol A with 2 mole of ethylene oxide | 553 parts |
| Adduct of bisphenol A with 2 mole of propylene oxide | 196 parts |
| Terephthalic acid | 220 parts |
| Adipic acid | 45 parts |
| Dibutyl tin oxide | 2 parts |

[Polyester 1] has a number average molecular weight of 2,200, a weight average molecular weight of 5,600, a glass transition temperature of 43° C., and an acid value of 24 mgKOH/g.

Polyester 2

The following components are placed in a container equipped with a condenser, a stirrer and a nitrogen introducing tube to conduct a reaction at 230° C. at normal pressure for 8 hours followed by another reaction for 8 hours with a reduced pressure of 10 to 15 mgHg and 26 parts by weight of trimellitic anhydride is added to the reaction container to conduct a reaction at 180° C. at normal pressure for 2 hours to obtain [Polyester 2].

| | |
|---|---|
| Adduct of bisphenol A with 2 mole of ethylene oxide | 264 parts |
| Adduct of bisphenol A with 2 mole of propylene oxide | 523 parts |
| Terephthalic acid | 123 parts |

-continued

| | |
|---|---|
| Adipic acid | 173 parts |
| Dibutyl tin oxide | 1 part |

[Polyester 2] has a number average molecular weight of 4000, a weight average molecular weight of 47,000, a glass transition temperature of 65° C., and an acid value of 12 mgKOH/g.

Vinyl Based Copolymer Resin Particulate V-1 Containing Releasing Agent 1.7 parts by weight of dodecyl sodium sulfate, 656 parts by weight of deionized water and 66.7 parts of paraffin wax (melting point: 72° C.) are placed in a reaction container equipped with a condenser, and a nitrogen introducing tube and heated to 80° C. Thereafter, the resultant is dispersed for 30 minutes using CLEAREMIX (manufactured by M Technique Co., Ltd.).

Then, CLEARMIX is replaced with a stirrer. A solution in which a 2.5 parts of potassium persulfate are dissolved in 100 parts of deinoized water is added and 15 minutes later, a mixture of 152 parts of styrene monomer, 38 parts of butyl acrylate, 10 parts of methacrylate, and 3.5 parts of n-Octyl mercaptan is dropped to the reaction container in 90 minutes. Then, the system is left at 80° C. for 60 minutes. Subsequent to cooling down, a liquid dispersion of [Vinyl based copolymer resin particulate V-1] is obtained.

The solid density of this liquid dispersion measured is 25%. The particulate has a volume average particle diameter is 110 nm. A small quantity of the liquid dispersion is placed in a petri dish and the solvent is evaporated to measure the solid material. The number average molecular weight is 10,500, and the weight average molecular weight is 17,000. Tg is not precisely obtained because Tg is overlapped with the melting point of the wax. The dried material of the particulates polymerized in the same manner without adding wax has a Tg of 65° C. for reference.

Vinyl Based Copolymer Resin Particulate V-2 Containing Releasing Agent 1.7 parts by weight of dodecyl sodium sulfate, 656 parts by weight of deionized water and 66.7 parts of paraffin wax (melting point: 72° C.) are placed in a reaction container equipped with a condenser, and a nitrogen introducing tube and heated to 80° C. Thereafter, the resultant is dispersed for 30 minutes using CLEAREMIX (manufactured by M Technique Co., Ltd.). Then, CLEARMIX is replaced with a stirrer. A solution in which a 2.5 parts of potassium persulfate are dissolved in 100 parts of deinoized water is added and 15 minutes later, a mixture of 150 parts of styrene monomer, 30 parts of butyl acrylate, 20 parts of methacrylate, and 3 parts of n-Octyl mercaptan is dropped to the reaction container in 90 minutes. Then, the system is left at 80° C. for 60 minutes. Subsequent to cooling down, a liquid dispersion of [Vinyl based copolymer resin particulate V-2] is obtained. The measuring result of the solid density of this liquid dispersion is 25%. The particulate has a volume average particle diameter is 130 nm. A small quantity of the liquid dispersion is placed in a petri dish and the solvent is evaporated to measure the solid material. The number average molecular weight is 14,000, and the weight average molecular weight is 29,000. Tg is not precisely obtained because Tg is overlapped with the melting point of the wax. The dried material of the particulates polymerized in the same manner without adding wax has a Tg of 69° C. for reference.

Vinyl Based Copolymer Resin Particulate V-3

1.7 parts of dodecyl sodium sulfate and 492 parts of deionized water are placed in a reaction container equipped with a condenser, a stirrer and a nitrogen introducing tube and heated to 80° C. A solution in which 2.5 parts of potassium perosulfate) are dissolved in 100 parts of deionized water is added to the reaction container and 15 minutes later, a liquid mixture of a 152 parts of styrene monomer, 38 parts of butyl acrylate, 10 parts methacrylic acid and 3.5 parts of n-octylmercaptan is dripped to the reaction container in 90 minutes. Thereafter, the reaction system is maintained at 80° C. for 60 minutes. Subsequent to cooling down, a liquid dispersion of [Vinyl based copolymer resin particulate V-3] is obtained. The measuring result of the solid density of this liquid dispersion is 25%. The particulate has a volume average particle diameter is 80 m. A small amount of the liquid dispersion is placed in a Petri dish and the solvent is evaporated to obtain a solid material. The solid material has a number average molecular weight of 11,000, a weight average molecular weight of 18,000, and a glass transition temperature of 65° C.

Synthesis of Prepolymer

The following components are placed in a container equipped with a condenser, a stirrer and a nitrogen introducing tube to conduct a reaction at 230° C. at normal pressure for 8 hours followed by another reaction for 5 hours with a reduced pressure of 10 to 15 mmHg to synthesize [Intermediate polyester resin 1]:

| | |
|---|---|
| 1,2-propylene glycol | 366 parts |
| Terephthalic acid | 566 parts |
| Trimellitic anhydride | 44 parts |
| Titan tetrabuthoxide | 6 parts |

[Intermediate Polyester 1] has a number average molecular weight of 3,200, a weight average molecular weight of 12,000, and a glass transition temperature of 55° C.

Next, 420 parts of [Intermediate polyester 1], 80 parts of isophorone diisocyanate and 500 parts of ethyl acetate are placed in a reaction container equipped with a condenser, stirrer and a nitrogen introducing tube to conduct reaction at 100° C. for 5 hours to obtain [Prepolymer]. The obtained [Prepolymer] has an isolated isocyanate in an amount of 1.34% by weight.

Synthesis of Master Batch 40 parts of carbon black (REGUL 400R, manufactured by Cabot Corporation), 60 parts of binder resin (polyester resin) (RS-801, manufactured by Sanyo Chemical Industries, Ltd., Acid value: 10, Mw: 20, 000, Tg: 64° C.) and 30 parts of water are mixed by a HENSCHEL MIXER to obtain a mixture in which water sops in a pigment agglomeration body. The mixture is mixed and kneaded for 45 minutes by two rolls where the temperature of the surface is set at 130° C. and pulverized by a pulverizer to the size of 1 mm Φ. Thus, [Master batch 1] is obtained.

Example 1

Preparation of Oil Phase 69.6 parts of [Polyester 1] and 85.6 parts of ethyl acetate are placed in a container equipped with a stirrer and a thermometer and maintained for 12 hours while being stirred. Next, 17.5 parts of [Master batch 1] and 17.5 parts of ethyl acetate are placed in the reaction container followed by stirring for 12 hours to obtain [Oil phase 1].

Preparation of Aqueous Phase 202 parts of deionized water, 6.4 parts of 25%byweight aqueous liquid dispersion of organic resin particulates (a copolymer of styrene-methacrylic acid-butyl acrylate-a sodium salt of sulfate of an adduct of methacrylic acid with ethyleneoxide) for stabilizing dispersion, 38.5 parts of 50% aqueous solution of sodium dodecyldiphenyl etherdisulfonate (EREMINOR MON-7, manufactured by Sanyo Chemical Industries, Ltd.), 48.2 parts of 1% aqueous solution of carboxymethyl cellulose as a viscosity improver, and 26 parts of ethyl acetate are mixed and stirred to obtain milk white liquid. This is determined as [Aqueous phase 1].

Emulsification Process 0.4 parts of isophorone diamine, 28.5 parts of [Prepolymer], and dried material of 64 parts of [Resin particulate V-1] are added to all the quantity of the [Oil phase 1] followed by mixing by TK HOMOMIXER (manufactured by Tokushu Kika Kogyo Co., Ltd.) at a rotation number of 5,000 rpm for 1 minute. All the [Aqueous phase 1] is admixed therewith by TK HOMOMIXER (manufactured by Tokushu Kika Kogyo Co., Ltd.) at a rotation number of from 8, 000 to 13,000 rpm for 20 minutes to obtain [Emulsified slurry 1].

Removal of Solvent

[Emulsified slurry 1] is placed in a container equipped with a stirrer and a thermometer and the solvent is removed at 30° C. for 8 hours to obtain [Slurry dispersion 1].

Washing and Drying

After 100 parts of [Slurry dispersion 1] is filtered with a reduced pressure; (I): 100 parts of deionized water is added to the filtered cake and the mixture is mixed by a TK HOMOMIXER at a rotation number of 12,000 rpm for 10 minutes; (II): 100 parts of deionized water is added to the filtered cake of (I) and the resultant is mixed by a TK HOMOMIXER at a rotation number of 12,000 rpm for 30 minutes while applying ultrasonic vibration thereto, and then filtered under a reduced pressure. This operation is repeated until the electric conductivity of the re-slurry liquid is not greater than 10 μS/cm; (III): 10% hydrochloric acid is added to the re-slurry liquid of (II) to make pH thereof be 4 followed by 30 minute stirring by a three one motor; and (IV): 100 parts of deionized water is added to the filtered cake of (III) and the resultant is mixed by a TK HOMOMIXER at a rotation number of 12,000 rpm for 10 minutes followed by filtration. This operation is repeated until the electric conductivity of the re-slurry liquid is not greater than 10 μS/cm. Thus, [Filtered cake 1] is obtained. The remaining [Slurry dispersion 1] is washed in the same manner and admixed as [Filtered cake 1]. [Filtered cake 1] is dried by a circulating drier at 45° C. for 48 hours. The dried cake is sieved using a screen having an opening of 75 μm to obtain [Mother toner 1]. The volume average particle diameter (Dv) is 5.0 μm, the number average particle diameter (Dp) is 4.5 μm, Dv/Dp is 1.11 and the average circularity is 0.971. 2 parts of hydrophobic silica having a primary particle diameter of about 30 nm and 1 part of hydrophobic silica having a primary particle diameter of about 10 nm are added to 100 parts of this [Mother toner 1] and mixed by a HENSCEL MIXER to obtain [Development agent 1] of the present invention.

Example 2

Preparation of Oil Phase 65.8 parts of [Polyester 1] and 85.8 parts of ethyl acetate are placed in a container equipped with a stirrer and a thermometer and maintained for 12 hours while being stirred. Next, 17.5 parts of [Master batch 1] and 17.5 parts of ethyl acetate are placed in the reaction container followed by stirring for 12 hours to obtain [Oil phase 2].

Emulsification Process 0.4 parts of isophorone diamine, 28.5 parts of [Prepolymer], and dried material of 80 parts of [Resin particulate V-1]

is added to all the quantity of the [Oil phase 2] followed by mixing by TK HOMOMIXER (manufactured by Tokushu Kika Kogyo Co., Ltd.) at a rotation number of 5,000 rpm for 1 minute. All the quantity of [Aqueous phase 1] is admixed therewith by TK HOMOMIXER (manufactured by Tokushu Kika Kogyo Co., Ltd.) at a rotation number of from 8,000 to 13,000 rpm for 20 minutes to obtain [Emulsified slurry 2]. The processes thereafter are performed in the same manner as in Example 1 to obtain [Mother toner 2]. The volume average particle diameter (Dv) is 5.1 μm, the number average particle diameter (Dp) is 4.6 μm, Dv/Dp is 1.11 and the average circularity is 0.972. 2 parts of hydrophobic silica having a primary particle diameter of about 30 nm and 1 part of hydrophobic silica having a primary particle diameter of about 10 nm are added to 100 parts of this [Mother toner 2] and mixed by a HENSCEL MIXER to obtain [Development agent 2] of the present invention.

Example 3

[Mother toner 3] is obtained in the same manner as in Example 2 except that [Resin particulate V-1] is changed to [Resin particulate V-2]. The volume average particle diameter (Dv) is 5.1 μm, the number average particle diameter (Dp) is 4.6 μm, Dv/Dp is 1.1 and the average circularity is 0.968. 2 parts of hydrophobic silica having a primary particle diameter of about 30 nm and 1 part of hydrophobic silica having a primary particle diameter of about 10 nm are added to 100 parts of this [Mother toner 3] and mixed by a HENSCEL MIXER to obtain [Development agent 3] of the present invention.

Example 4

Preparation of Oil Phase 55.9 parts of [Polyester 1] and 85.9 parts of ethyl acetate are placed in a container equipped with a stirrer and a thermometer and maintained for 12 hours while being stirred. Next, 17.5 parts of [Master batch 1] and 17.5 parts of ethyl acetate are placed in the reaction container followed by stirring for 12 hours to obtain [Oil phase 4].

Emulsification Process 0.4 parts of isophorone diamine, 28.2 parts of [Prepolymer], and dried material of 120 parts of [Resin particulate V-2] is added to all the quantity of the [Oil phase 4] followed by mixing by TK HOMOMIXER (manufactured by Tokushu Kika Kogyo Co., Ltd.) at a rotation number of 5,000 rpm for 1 minute. All the quantity of [Aqueous phase 1] is admixed therewith by TK HOMOMIXER (manufactured by Tokushu Kika Kogyo Co., Ltd.) at a rotation number of from 8,000 to 13,000 rpm for 20 minutes to obtain [Emulsified slurry 4].

The processes thereafter are performed in the same manner as in Example 1 to obtain [Mother toner 4].

The volume average particle diameter (Dv) is 5.0 μm, the number average particle diameter (Dp) is 4.4 μm, Dv/Dp is 1.14 and the average circularity is 0.967. 2 parts of hydrophobic silica having a primary particle diameter of about 30 m and 1 part of hydrophobic silica having a primary particle diameter of about 10 nm are added to 100 parts of this [Mother toner 4] and mixed by a HENSCEL MIXER to obtain [Development agent 4] of the present invention.

Example 5

Preparation of Aqueous Phase 154 parts of deionized water, 6.4 parts of 25% by weight aqueous liquid dispersion of organic resin particulates (a copolymer of styrene-methacrylic acid-butyl acrylate-a sodium salt of sulfate of an adduct of methacrylic acid with ethyleneoxide) for stabilizing dispersion, 38.5 parts of 50% aqueous solution of sodium dodecyldiphenyl etherdisulfonate (EREMINOR MON-7, manufactured by Sanyo Chemical Industries, Ltd.), 48.2 parts of 1% aqueous solution of carboxymethyl cellulose as a viscosity improver, 64 parts of [Resin particulate V-1], and 26 parts of ethyl acetate are mixed and stirred to obtain milk white liquid. This is determined as [Aqueous phase 5].

Emulsification Process 0.4 parts of isophorone diamine and 28.5 parts of [Prepolymer] are added to all the quantity of the [Oil phase 1] followed by mixing by TK HOMOMIXER (manufactured by Tokushu Kika Kogyo Co., Ltd.) at a rotation number of 5,000 rpm for 1 minute. All the quantity of [Aqueous phase 5] is admixed therewith by TK HOMOMIXER (manufactured by Tokushu Kika Kogyo Co., Ltd.) at a rotation number of from 8,000 to 13,000 rpm for 20 minutes to obtain [Emulsified slurry 5]. The processes thereafter are performed in the same manner as in Example 1 to obtain [Mother toner 5]. The volume average particle diameter (Dv) is 5.4 μm, the number average particle diameter (Dp) is 4.8 μm, Dv/Dp is 1.13 and the average circularity is 0.965. 2 parts of hydrophobic silica having a primary particle diameter of about 30 nm and 1 part of hydrophobic silica having a primary particle diameter of about 10 nm are added to 100 parts of this [Mother toner 5] and mixed by a HENSCEL MIXER to obtain [Development agent 5] of the present invention.

Example 6

Preparation of Aqueous Phase 138 parts of deionized water, 6.4 parts of 25% by weight aqueous liquid dispersion of organic resin particulates (a copolymer of styrene-methacrylic acid-butyl acrylate-a sodium salt of sulfate of an adduct of methacrylic acid with ethyleneoxide) for stabilizing dispersion, 38.5 parts of 50% aqueous solution of sodium dodecyldiphenyl etherdisulfonate (EREMINOR MON-7, manufactured by Sanyo Chemical Industries, Ltd.), 48.2 parts of 1% aqueous solution of carboxymethyl cellulose as a viscosity improver, 80 parts of [Resin particulate V-2] and 26 parts of ethyl acetate are mixed and stirred to obtain milk white liquid. This is determined as [Aqueous phase 6].

Emulsification Process 0.4 parts of isophorone diamine and 28.5 parts of [Prepolymer] are added to all the quantity of the [Oil phase 1] followed by mixing by TK HOMOMIXER (manufactured by Tokushu Kika Kogyo Co., Ltd.) at a rotation number of 5,000 rpm for 1 minute. All the quantity of [Aqueous phase 5] is admixed therewith by TK HOMOMIXER (manufactured by Tokushu Kika Kogyo Co., Ltd.) at a rotation number of from 8,000 to 13,000 rpm for 20 minutes to obtain [Emulsified slurry 6]. The processes thereafter are performed in the same manner as in Example 1 to obtain [Mother toner 6]. The volume average particle diameter (Dv) is 5.3 μm, the number average particle diameter (Dp) is 4.7 μm, Dv/Dp is 1.13 and the average circularity is 0.966. 2 parts of hydrophobic silica having a primary particle diameter of about 30 nm and 1 part of hydrophobic silica having a primary particle diameter of about 10 nm are added to 100 parts of this [Mother toner 6] and mixed by a HENSCEL MIXER to obtain [Development agent 6] of the present invention.

Example 7

Preparation of Oil Phase 62.5 parts of [Polyester 1], 21.4 parts of [Polyester 2] and 103.9 parts of ethyl acetate are placed in a container equipped with a stirrer and a thermometer and maintained for 12 hours while being stirred. Next, 17.5 parts of [Master batch 1] and 17.5 parts of ethyl acetate are placed in the reaction container followed by stirring for 12 hours to obtain [Oil phase 7].

Emulsification Process

Dried material of 64 parts of [Resin particulate V-1] is added to all the quantity of the [Oil phase 7] followed by mixing by TK HOMOMIXER (manufactured by Tokushu Kika Kogyo Co., Ltd.) at a rotation number of 5,000 rpm for 1 minute. All the quantity of [Aqueous phase 1] is admixed therewith by TK HOMOMIXER (manufactured by Tokushu Kika Kogyo Co., Ltd.) at a rotation number of from 8,000 to 13,000 rpm for 20 minutes to obtain [Emulsified slurry 7]. The processes thereafter are performed in the same manner as in Example 1 to obtain [Mother toner 7]. The volume average particle diameter (Dv) is 5.1 μm, the number average particle diameter (Dp) is 4.5 μm, Dv/Dp is 1.13 and the average circularity is 0.970. 2 parts of hydrophobic silica having a primary particle diameter of about 30 nm and 1 part of hydrophobic silica having a primary particle diameter of about 10 nm are added to 100 parts of this [Mother toner 7] and mixed by a HENSCEL MIXER to obtain [Development agent 7] of the present invention.

Example 8

Preparation of Oil Phase 55.5 parts of [Polyester 1], 28.4 parts of [Polyester 2] and 107.9 parts of ethyl acetate are placed in a container equipped with a stirrer and a thermometer and maintained for 12 hours while being stirred. Next, 17.5 parts of [Master batch 1] and 17.5 parts of ethyl acetate are placed in the reaction container followed by stirring for 12 hours to obtain [Oil phase 8].

Emulsification Process

Dried material of 64 parts of [Resin particulate V-1] is added to all the quantity of the [Oil phase 8] followed by mixing by TK HOMOMIXER (manufactured by Tokushu Kika Kogyo Co., Ltd.) at a rotation number of 5,000 rpm for 1 minute. All the quantity of [Aqueous phase 1] is admixed therewith by TK HOMOMIXER (manufactured by Tokushu Kika Kogyo Co., Ltd.) at a rotation number of from 8,000 to 13,000 rpm for 20 minutes to obtain [Emulsified slurry 8]. The processes thereafter are performed in the same manner as in Example 1 to obtain [Mother toner 8]. The volume average particle diameter (Dv) is 5.2 μm, the number average particle diameter (Dp) is 4.6 μm, Dv/Dp is 1.13 and the average circularity is 0.969. 2 parts of hydrophobic silica having a primary particle diameter of about 30 nm and 1 part of hydrophobic silica having a primary particle diameter of about 10 nm are added to 100 parts of this [Mother toner 8] and mixed by a HENSCEL MIXER to obtain [Development agent 8] of the present invention.

Example 9

[Mother toner 9] is obtained in the same manner as in Example 8 except that [Resin particulate V-1] is changed to [Resin particulate V-2]. The volume average particle diameter (Dv) is 5.3 μm, the number average particle diameter (Dp) is 4.7 μm, Dv/Dp is 1.13 and the average circularity is 0.969. 2 parts of hydrophobic silica having a primary particle diameter of about 30 nm and 1 part of hydrophobic silica having a primary particle diameter of about 10 m are added to 100 parts of this [Mother toner 9] and mixed by a HENSCEL MIXER to obtain [Development agent 9] of the present invention.

Example 10

Emulsification Process

All the quantity of the [Oil phase 7] is stirred by TK HOMOMIXER manufactured by Tokushu Kika Kogyo Co., Ltd.) at a rotation number of 5,000 rpm for 1 minute. All the quantity of [Aqueous phase 5] is admixed therewith by TK HOMOMIXER (manufactured by Tokushu Kika Kogyo Co., Ltd.) at a rotation number of from 8,000 to 13,000 rpm for 20 minutes to obtain [Emulsified slurry 10]. The processes thereafter are performed in the same manner as in Example 1 to obtain [Mother toner 10]. The volume average particle diameter (Dv) is 5.2 μm, the number average particle diameter (Dp) is 4.6 μm, Dv/Dp is 1.13 and the average circularity is 0.966. 2 parts of hydrophobic silica having a primary particle diameter of about 30 nm and 1 part of hydrophobic silica having a primary particle diameter of about 10 nm are added to 100 parts of this [Mother toner 10] and mixed by a HENSCEL MIXER to obtain [Development agent 10] of the present invention.

Comparative Example 1

Preparation of Oil Phase 24 parts of [Polyester 1], 8 parts of paraffin wax (melting point: 72° C.), and 96 pars of ethyl acetate are placed in a reaction container equipped with a stirrer and a thermometer. After the system is heated to 80° C. while stirring, the system is maintained at 80° C. for 5 hours and then cooled down to 30° C. in one hour. 35 parts of [master batch 1] is admixed for one hour and the mixture is transferred to another vessel to disperse the mixture using a bead mill (ULTRAVISCOMILL from AIMEX) under the following conditions: Liquid feeding speed: 1 kg/hour; Disc rotation perimeter speed: 6 m/sec; Diameter of zirconia beads: 0.5 mm; Filling factor of zirconia beads: 80% by volume; Repeat number of dispersion treatment: 3 times; to obtain [Material solution 11]. Next, 84.4 parts of 70% ethyl acetate solution of [Polyester 1] is added to 81.3 parts of [Material solution 11] followed by 2 hour stirring with a three one motor to obtain [Oil phase 11]. Ethyl acetate is added to [Oil phase 11] to adjust the solid portion density to be 50%. The solid portion density is measured by heating [Oil phase 11] at 130° C. for 30 minutes and then cooling it down.

Emulsification Process 0.4 parts of isophorone diamine and 28.8 parts of [Prepolymer] are added to all the quantity of the [Oil phase 11] followed by mixing by TK HOMOMIXER (manufactured by Tokushu Kika Kogyo Co., Ltd.) at a rotation number of 5,000 rpm for 1 minute. 321 parts of [Aqueous phase 1] is admixed therewith by TK HOMOMIXER (manufactured by Tokushu Kika Kogyo Co., Ltd.) at a rotation number of from 8,000 to 13,000 rpm for 20 minutes to obtain [Emulsified slurry 7]. The processes thereafter are performed in the same manner as in Example 1 to obtain [Mother toner 11]. The volume average particle diameter (Dv) is 5.3 μm, the number average particle diameter (Dp) is 4.7 μm, Dv/Dp is 1.13 and the average circularity is 0.965. 2 parts of hydrophobic silica having a primary particle diameter of about 30 nm and 1 part of hydrophobic silica having a primary particle diameter of about 10 nm are added to 100 parts of this [Mother toner 11]

and mixed by a HENSCEL MIXER to obtain [Development agent 11] of Comparative Examples.

Comparative Example 2

Preparation of Oil Phase 30 parts of [Polyester 1], 10 parts of paraffin wax (melting point: 72° C.), and 107 pars of ethyl acetate are placed in a reaction container equipped with a stirrer and a thermometer. After the system is heated to 80° C. while stirring, the system is maintained at 80° C. for 5 hours and then cooled down to 30° C. in one hour. 35 parts of [master batch 1] is admixed for one hour and the mixture is transferred to another vessel to disperse the mixture using a bead mill (ULTRAVISCOMILL from AIMEX) under the following conditions: Liquid feeding speed: 1 kg/hour; Disc rotation perimeter speed: 6 m/sec; Diameter of zirconia beads: 0.5 mm; Filling factor of zirconia beads: 80% by volume; Repeat number of dispersion treatment: 3 times; to obtain [Material solution 12]. Next, 78.9 parts of 70% ethyl acetate solution of [Polyester 1] is added to 91.1 parts of [Material solution 12] followed by a 2 hour stirring with a three one motor to obtain [Oil phase 12]. [Ethyl acetate is added to [Oil phase 12] to adjust the solid portion density to be 50%. The solid portion density is measured by heating [Oil phase 12] at 130° C. for 30 minutes and then cooling it down.

Emulsification Process 0.4 parts of isophorone diamine and 28.5 parts of [Prepolymer] are added to all the quantity of the [Oil phase 12] followed by mixing by TK HOMOMIXER (manufactured by Tokushu Kika Kogyo Co., Ltd.) at a rotation number of 5,000 rpm for 1 minute. 321 parts of [Aqueous phase 1] is admixed therewith by TK HOMOMIXER (manufactured by Tokushu Kika Kogyo Co., Ltd.) at a rotation number of from 8,000 to 13,000 rpm for 20 minutes to obtain [Emulsified slurry 12]. The processes thereafter are performed in the same manner as in Example 1 to obtain [Mother toner 12]. The volume average particle diameter (Dv) is 5.1 μm, the number average particle diameter (Dp) is 4.5 μm, Dv/Dp is 1.13 and the average circularity is 0.968. 2 parts of hydrophobic silica having a primary particle diameter of about 30 nm and 1 part of hydrophobic silica having a primary particle diameter of about 10 nm are added to 100 parts of this [Mother toner 12] and mixed by a HENSCEL MIXER to obtain [Development agent 12] of Comparative Examples.

Comparative Example 3

Preparation of Oil Phase 24 parts of [Polyester 1], 8 parts of paraffin wax (melting point: 72° C.), and 96 pars of ethyl acetate are placed in a reaction container equipped with a stirrer and a thermometer. After the system is heated to 80° C. while stirring, the system is maintained at 80° C. for 5 hours and then cooled down to 30° C. in one hour. 35 parts of [master batch 1] is admixed for one hour and the mixture is transferred to another vessel to disperse the mixture using a bead mill (ULTRAVISCOMILL from AIMEX) under the following conditions: Liquid feeding speed: 1 kg/hour; Disc rotation perimeter speed: 6 m/sec; Diameter of zirconia beads: 0.5 mm; Filling factor of zirconia beads: 80% by volume; Repeat number of dispersion treatment: 3 times; to obtain [Material solution 13]. Next, 67.3 parts of 70% ethyl acetate solution of [Polyester 1] is added to 81.3 parts of [Material solution 13] followed by a 2 hour stirring with a three one motor to obtain [Oil phase 13]. Ethyl acetate is added to [Oil phase 13] to adjust the solid portion density to be 50%. The solid portion density is measured by heating [Oil phase 13] at 130° C. for 30 minutes and then cooling it down.

Emulsification Process 0.4 parts of isophorone diamine, 28.8 parts of [Prepolymer], 12 parts of ethyl acetate, and dried material of 48 parts of [Resin particulate V-3] are added to all the quantity of the [Oil phase 13] followed by mixing by TK HOMOMIXER (manufactured by Tokushu Kika Kogyo Co., Ltd.) at a rotation number of 5,000 rpm for 1 minute. 321 parts of [Aqueous phase 1] is admixed therewith by TK HOMOMIXER (manufactured by Tokushu Kika Kogyo Co., Ltd.) at a rotation number of from 8,000 to 13,000 rpm for 20 minutes to obtain [Emulsified slurry 13]. The processes thereafter are performed in the same manner as in Example 1 to obtain [Mother toner 13]. The volume average particle diameter (Dv) is 5.2 μm, the number average particle diameter (Dp) is 4.7 μm, Dv/Dp is 1.11 and the average circularity is 0.966. 2 parts of hydrophobic silica having a primary particle diameter of about 30 nm and 1 part of hydrophobic silica having a primary particle diameter of about 10 nm are added to 100 parts of this [Mother toner 13] and mixed by a HENSCEL MIXER to obtain [Development agent 13] of Comparative Examples.

Comparative Example 4

Preparation of Aqueous Phase 154 parts of deionized water, 6.4 parts of 25% by weight aqueous liquid dispersion of organic resin particulates (a copolymer of styrene-methacrylic acid-butyl acrylate-a sodium salt of sulfate of an adduct of methacrylic acid with ethyleneoxide) for stabilizing dispersion, 38.5 parts of 50% aqueous solution of sodium dodecyldiphenyl etherdisulfonate (EREMINOR MON-7, manufactured by Sanyo Chemical Industries, Ltd.), 48.2 parts of 1% aqueous solution of carboxymethyl cellulose as a viscosity improver, 64 parts of [Resin particulate V-3] and 26 parts of ethyl acetate are mixed and stirred to obtain milk white liquid. This is determined as [Aqueous phase 14].

Emulsification Process 0.4 parts of isophorone diamine, 28.8 parts of [Prepolymer], and 12 parts of ethyl acetate are added to all the quantity of the [Oil phase 13] followed by mixing by TK HOMOMIXER (manufactured by Tokushu Kika Kogyo Co., Ltd.) at a rotation number of 5,000 rpm for 1 minute. All the quantity of [Aqueous phase 14] is admixed therewith by TK HOMOMIXER (manufactured by Tokushu Kika Kogyo Co., Ltd.) at a rotation number of from 8,000 to 13,000 rpm for 20 minutes to obtain [Emulsified slurry 14]. The processes thereafter are performed in the same manner as in Example 1 to obtain [Mother toner 14]. The volume average particle diameter (Dv) is 5.4 μm, the number average particle diameter (Dp) is 4.8 μm, Dv/Dp is 1.13 and the average circularity is 0.967. 2 parts of hydrophobic silica having a primary particle diameter of about 30 nm and 1 part of hydrophobic silica having a primary particle diameter of about 10 nm are added to 100 parts of this [Mother toner 14] and mixed by a HENSCEL MIXER to obtain [Development agent 14] of Comparative Examples.

Comparative Example 5

Preparation of Oil Phase

Next, 74.1 parts of 70% ethyl acetate solution of [Polyester 1], 21.6 parts of [Polyester 2], and 21.5 parts of ethyl acetate are added to 81.3 parts of [Material solution 13] followed by a 2 hour stirring with a three one motor to obtain [Oil phase 15]. Ethyl acetate is added to [Oil phase 15] to adjust the solid portion density to be 49%. The solid portion density is measured by heating [Oil phase 15] at 130° C. for 30 minutes and then cooling it down.

Emulsification Process

All the quantity of the [Oil phase 15] is stirred by TK HOMOMIXER (manufactured by Tokushu Kika Kogyo Co., Ltd.) at a rotation number of 5,000 rpm for 1 minute. 321 parts of [Aqueous phase 1] is admixed therewith by TK HOMOMIXER (manufactured by Tokushu Kika Kogyo Co., Ltd.) at a rotation number of from 8,000 to 13,000 rpm for 20 minutes to obtain [Emulsified slurry 15]. The processes thereafter are performed in the same manner as in Example 1 to obtain [Mother toner 15]. The volume average particle diameter (Dv) is 5.4 μm, the number average particle diameter (Dp) is 4.8 μm, Dv/Dp is 1.13 and the average circularity is 0.965. 2 parts of hydrophobic silica having a primary particle diameter of about 30 nm and 1 part of hydrophobic silica having a primary particle diameter of about 10 nm are added to 100 parts of this [Mother toner 15] and mixed by a HENSCEL MIXER to obtain [Development agent 15] of Comparative Examples.

Comparative Example 6

Preparation of Oil Phase

Next, 57 parts of 70% ethyl acetate solution of [Polyester 1], 21.6 parts of [Polyester 2], and 21.5 parts of ethyl acetate are added to 81.3 parts of [Material solution 13] followed by 2 hour stirring with a three one motor to obtain [Oil phase 16]. [Ethyl acetate is added to [Oil phase 16] to adjust the solid portion density to be 49%. The solid portion density is measured by heating [Oil phase 16] at 130° C. for 30 minutes and then cooling it down.

Emulsification Process 12 parts of ethyl acetate and dried material of 48 parts of [Resin particulate V-3] are added to all the quantity of the [Oil phase 16] followed by mixing by TK HOMOMIXER (manufactured by Tokushu Kika Kogyo Co., Ltd.) at a rotation number of 5,000 rpm for 1 minute. 321 parts of [Aqueous phase 1] is admixed therewith by TK HOMOMIXER (manufactured by Tokushu Kika Kogyo Co., Ltd.) at a rotation number of from 8,000 to 13,000 rpm for 20 minutes to obtain [Emulsified slurry 16]. The processes thereafter are performed in the same manner as in Example 1 to obtain [Mother toner 16]. The volume average particle diameter (Dv) is 5.3 μm, the number average particle diameter (Dp) is 4.7 μm, Dv/Dp is 1.13 and the average circularity is 0.967. 2 parts of hydrophobic silica having a primary particle diameter of about 30 nm and 1 part of hydrophobic silica having a primary particle diameter of about 10 nm are added to 100 parts of this [Mother toner 16] and mixed by a HENSCEL MIXER to obtain [Development agent 16] of Comparative Examples.

The physical properties and the evaluation results are shown for each development agent obtained in Examples and Comparative Examples described above.

According to the evaluation results, the toners of the present invention are excellent. On the other hand, the typical toners of Comparative Examples have problems with durability and high temperature preservability since the toners move to the regulation member, which seems to be ascribable to the exposure of the releasing agent. In addition, the releasing agent does not sufficiently ooze at a high speed fixing.

TABLE 1-1

| | Dev. agent | Toner particle diameter Dv | Dp | Dv/Dp | Form Circularity |
|---|---|---|---|---|---|
| Example 1 | 1 | 5.0 | 4.5 | 1.11 | 0.971 |
| Example 2 | 2 | 5.1 | 4.6 | 1.11 | 0.972 |
| Example 3 | 3 | 5.1 | 4.6 | 1.11 | 0.968 |
| Example 4 | 4 | 5.0 | 4.4 | 1.14 | 0.967 |
| Example 5 | 5 | 5.4 | 4.8 | 1.13 | 0.965 |
| Example 6 | 6 | 5.3 | 4.7 | 1.13 | 0.966 |
| Example 7 | 7 | 5.1 | 4.5 | 1.13 | 0.970 |
| Example 8 | 8 | 5.2 | 4.6 | 1.13 | 0.969 |
| Example 9 | 9 | 5.3 | 4.7 | 1.13 | 0.969 |
| Example 10 | 10 | 5.2 | 4.6 | 1.13 | 0.966 |
| Comparative Example 1 | 11 | 5.3 | 4.7 | 1.13 | 0.965 |
| Comparative Example 2 | 12 | 5.1 | 4.5 | 1.13 | 0.968 |
| Comparative Example 3 | 13 | 5.2 | 4.7 | 1.11 | 0.966 |
| Comparative Example 4 | 14 | 5.4 | 4.8 | 1.13 | 0.967 |
| Comparative Example 5 | 15 | 5.4 | 4.8 | 1.13 | 0.965 |
| Comparative Example 6 | 16 | 5.3 | 4.7 | 1.13 | 0.967 |

TABLE 1-2

| | Endothermic amount of releasing agent (mJ/mg) | Evaluation result Anti-stress property | Fixing separability | High temperature preservability |
|---|---|---|---|---|
| Example 1 | 6.2 | E | G | E |
| Example 2 | 7.5 | E | E | G |
| Example 3 | 7.3 | E | G | G |
| Example 4 | 9.1 | G | E | G |
| Example 5 | 5.9 | G | E | G |
| Example 6 | 7.1 | E | E | G |
| Example 7 | 6.3 | E | G | G |
| Example 8 | 6.2 | E | E | E |
| Example 9 | 7.4 | E | G | G |
| Example 10 | 6.4 | G | G | G |
| Comparative Example 1 | 6.5 | G | F | F |
| Comparative Example 2 | 7.4 | G | G | B |
| Comparative Example 3 | 6.1 | F | B | F |
| Comparative Example 4 | 6.3 | G | B | F |
| Comparative Example 5 | 6.6 | G | F | B |
| Comparative Example 6 | 6.2 | F | B | B |

This document claims priority and contains subject matter related to Japanese Patent Applications No. 2008-225546 and 2009-142185, filed on Sep. 3, 2008, and Jun. 15, 2009, respectively, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising:

a resin having a polyester skeleton;

a coloring agent;

a vinyl based copolymer resin; and a releasing agent, wherein the toner is manufactured by dissolving or dispersing a resin comprising the resin having a polyester skeleton and a mixture of the vinyl based copolymer resin and the releasing agent in an organic solvent to obtain a lysate and a dispersion material, dispersing the lysate and the dispersion material in an aqueous medium to obtain a liquid dispersion and removing the organic solvent from the liquid dispersion, wherein the mixture of the vinyl based copolymer resin and the releasing agent is prepared by emulsification polymerization in an aqueous medium in which the releasing agent is dispersed.

2. A toner comprising:

a resin having a polyester skeleton;

a coloring agent a vinyl based copolymer resin; and a releasing agent, wherein the toner is manufactured by dissolving or dispersing a resin comprising the resin having a polyester skeleton in an organic solvent to obtain a lysate and dispersion material, dispersing the lysate and the dispersion material in an aqueous medium in which a mixture of the vinyl based copolymer resin and the releasing agent is dispersed to obtain a liquid dispersion and removing the organic solvent from the liquid dispersion, wherein the mixture of the vinyl based copolymer resin and the releasing agent is prepared by emulsification polymerization in an aqueous medium in which the releasing agent is dispersed.

3. The toner according to claim 1, wherein the releasing agent is paraffin wax, Fischer-Tropsch wax, or a polyethylene wax.

4. The toner according to Claim 1, wherein the mixture of the vinyl based copolymer resin and the releasing agent has a volume average particle diameter of 0.2 μm or less.

5. The toner according to claim 1, wherein the mixture of the vinyl based copolymer resin and the releasing agent is prepared by emulsification polymerization in an aqueous medium in which the releasing agent is dispersed.

6. The toner according to claim 1, wherein the releasing agent has an endothermic amount from 5.9 mJ/mg to 10 mJ/mg based on melting heat of the releasing agent in the toner according to measurement by a differential scanning calorimeter (DSC).

7. The toner according to claim 1, wherein the resin comprising the resin having a polyester skeleton comprises a modified polyester resin having at least one of a urethane group and a urea group.

8. The toner according to claim 7, wherein the polyester resin comprises a modified polyester component prepared by reaction between a modified polyester having an isocyanate group at an end thereof and an amine.

9. The toner according to claim 2, wherein a vinyl based copolymer resin particulate comprising no releasing agent is preliminarily dispersed in the aqueous medium.

10. The toner according to claim 2, wherein the releasing agent is paraffin wax, Fischer-Tropsch wax, or a polyethylene wax.

11. The toner according to claim 2, wherein the mixture of the vinyl based copolymer resin and the releasing agent has a volume average particle diameter of 0.2 μm or less.

12. The toner according to claim 2, wherein the mixture of the vinyl based copolymer resin and the releasing agent is prepared by emulsification polymerization in an aqueous medium in which the releasing agent is dispersed.

13. The toner according to claim 2, wherein the releasing agent has an endothermic amount from 5.9 mJ/mg to 10 mJ/mg based on melting heat of the releasing agent in the toner according to measurement by a differential scanning calorimeter (DSC).

14. The toner according to claim 2, wherein the resin comprising the resin having a polyester skeleton comprises a modified polyester resin having at least one of a urethane group and a urea group.

15. The toner according to claim 14, wherein the polyester resin comprises a modified polyester component prepared by reaction between a modified polyester having an isocyanate group at an end thereof and an amine.

16. A process cartridge comprising:

an image bearing member configured to bear a latent electrostatic image thereon; and a development device configured to develop the latent electrostatic image on the image bearing member, the development device comprising a development agent bearing member configured to bear a development agent comprising the toner of claim 1 on a surface thereof, a development device supplying member configured to supply the development agent to the surface of the development agent bearing device, and a development agent container configured to contain the development agent, wherein the process cartridge is detachably attachable to an image forming apparatus.

17. A process cartridge comprising:

an image bearing member configured to bear a latent electrostatic image thereon; and a development device configured to develop the latent electrostatic image on the image bearing member, the development device comprising a development agent bearing member configured to bear a development agent comprising the toner of claim 2 on a surface thereof, a development device supplying member configured to supply the development agent to the surface of the development agent bearing device, and a development agent container configured to contain the development agent, wherein the process cartridge is detachably attachable to an image forming apparatus.

18. A method of forming an image comprising:

uniformly charging a surface of an image bearing member;

irradiating the surface of the image bearing member with light according to image data to write a latent electrostatic image on the surface;

developing the latent electrostatic image formed on the surface of the image bearing member via a layer of a development agent comprising the toner of claim 1 which is formed on a development agent bearing member with a predetermined thickness regulated by a development agent layer regulation member to obtain a visualized image;

transferring the visualized image to a transfer medium; and fixing the visualized image on the transfer medium.

19. A method of forming an image comprising:

uniformly charging a surface of an image hearing member;

irradiating the surface of the image bearing member with light according to image data to write a latent electrostatic image on the surface;

developing the latent electrostatic image formed on the surface of the image bearing member via a layer of a development agent comprising the toner of claim 2 which is formed on a development agent bearing member with a predetermined thickness regulated by a development agent layer regulation member to obtain a visualized image;

transferring the visualized image to a transfer medium; and fixing the visualized image on the transfer medium.

* * * * *